US009290253B2

(12) United States Patent
Kuriyagawa et al.

(10) Patent No.: US 9,290,253 B2
(45) Date of Patent: Mar. 22, 2016

(54) OUTBOARD MOTOR CONTROL APPARATUS

(71) Applicant: HONDA MOTOR CO., LTD., Minato-Ku, Tokyo (JP)

(72) Inventors: Koji Kuriyagawa, Wako (JP); Hajime Yoshimura, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 134 days.

(21) Appl. No.: 14/169,545

(22) Filed: Jan. 31, 2014

(65) Prior Publication Data

US 2014/0220837 A1 Aug. 7, 2014

(30) Foreign Application Priority Data

Feb. 1, 2013 (JP) ..... 2013-018812
Feb. 1, 2013 (JP) ..... 2013-018813
Feb. 1, 2013 (JP) ..... 2013-018814

(51) Int. Cl.
*B63H 21/21* (2006.01)
*B63H 20/12* (2006.01)
*B63H 20/00* (2006.01)

(52) U.S. Cl.
CPC ..... *B63H 21/21* (2013.01); *B63H 20/12* (2013.01); *B63H 2020/003* (2013.01)

(58) Field of Classification Search
CPC ..... B63H 2023/0258; B63H 21/21
See application file for complete search history.

(56) References Cited

U.S. PATENT DOCUMENTS 8,444,446 B2 5/2013 Kuriyagawa et al.
2011/0217886 A1* 9/2011 Kuriyagawa et al. ..... 440/1
2011/0294375 A1* 12/2011 Kuriyagawa et al. ..... 440/1

* cited by examiner

*Primary Examiner* — Edwin Swinehart
(74) *Attorney, Agent, or Firm* — Carrier Blackman & Associates, P.C.; William D. Blackman; Joseph P. Carrier

(57) ABSTRACT

A control apparatus for an outboard motor mounted on a boat and equipped with a transmission having at least forward first and second speed gears and a reverse gear. The apparatus functions as a rudder angle detector that detects a rudder angle, a slip ratio detector that detects a slip ratio, and a transmission controller. The transmission controller controls the operation of the transmission to select one of the gears based on the detected engine speed or the detected slip ratio according to a comparison between the detected rudder angle and a predetermined angle.

10 Claims, 17 Drawing Sheets

OUTBOARD MOTOR CONTROL APPARATUS

TECHNICAL FIELD

Embodiments of the invention generally relate to an outboard motor control apparatus, more particularly to a control apparatus for a plurality of outboard motors installed on a boat and each equipped with a transmission.

RELATED ART

With reference to a boat installed with an outboard motor equipped with a transmission, there has been proposed a technique to suppress cavitation occurring around a propeller when the boat is steered to turn so as to turn the boat smoothly, for example, by U.S. Pat. No. 8,444,446 filed and patented claiming the priority of Japanese Laid-Open Patent Application No. 2011-183903.

In the reference, the operation of the transmission is controlled to change the gear position from a second speed to a first speed when detected throttle change amount not less than a first predetermined value and operation of the trim angle regulation mechanism is controlled to start the trim-up operation such that the trim angle converges to a predetermined angle, the operation of the trim angle regulation mechanism is controlled such that the trim angle is decreased based on the detected rudder angle when steering of the outboard motor is started, thereby enabling to appropriately prevent cavitation caused by steering of the outboard motor, so that the boat can be smoothly turned.

SUMMARY

In the reference, occurrence of cavitation is suppressed by shifting down when the detected rudder angle is equal to or greater than the predetermined rudder angle. However, since occurrence of cavitation at turning of the boat differs according to the operating conditions of an engine or the transmission, or the specifications of the propeller, and the like, cavitation scarcely occurs depending on conditions even with a relatively large rudder angle. Therefore, it is not always best to shift down only based on the rudder angle without exception.

Therefore, embodiments of the invention are directed to overcoming the foregoing problems by providing a control apparatus for a boat installed with outboard motors that effectively suppresses occurrence of cavitation to facilitate smooth turning of the boat by selecting gear of the transmission based on a slip ratio of the propeller when the rudder angle is relatively large.

In order to achieve the object, embodiments of the invention provide an apparatus for controlling the operation of a plurality of outboard motors adapted to be mounted on a stern of a hull of a boat side by side and each equipped with an internal combustion engine to power a propeller through a power transmission shaft and a transmission having at least forward first and second speed gears and a reverse gear each supported on the power transmission shaft, comprising: an engine speed detector that detects an engine speed of the engine; a rudder angle detector that detects a rudder angle of the outboard motors relative to the hull; a slip ratio detector that detects a slip ratio of the propeller of the hull based on a theoretical navigation speed and an actual navigation speed of the boat; and a transmission controller that controls the operation of the transmission to select one of the gears based on at least the detected engine speed when the detected rudder angle is smaller than a predetermined first angle $\alpha 1$, while to select one of the gears based on the detected slip ratio when the detected rudder angle is equal to or greater than the predetermined angle; specifically, configured to select the gear based on the slip ratio when the boat turns at the predetermined angle or more.

BRIEF DESCRIPTION OF THE DRAWINGS

The above and other objects and advantages of embodiments of the invention will be more apparent from the following descriptions and drawings in which.

DESCRIPTION OF EMBODIMENTS

An outboard motor control apparatus according to a first embodiment of the invention will now be explained with reference to the attached drawings.

Figure 1:
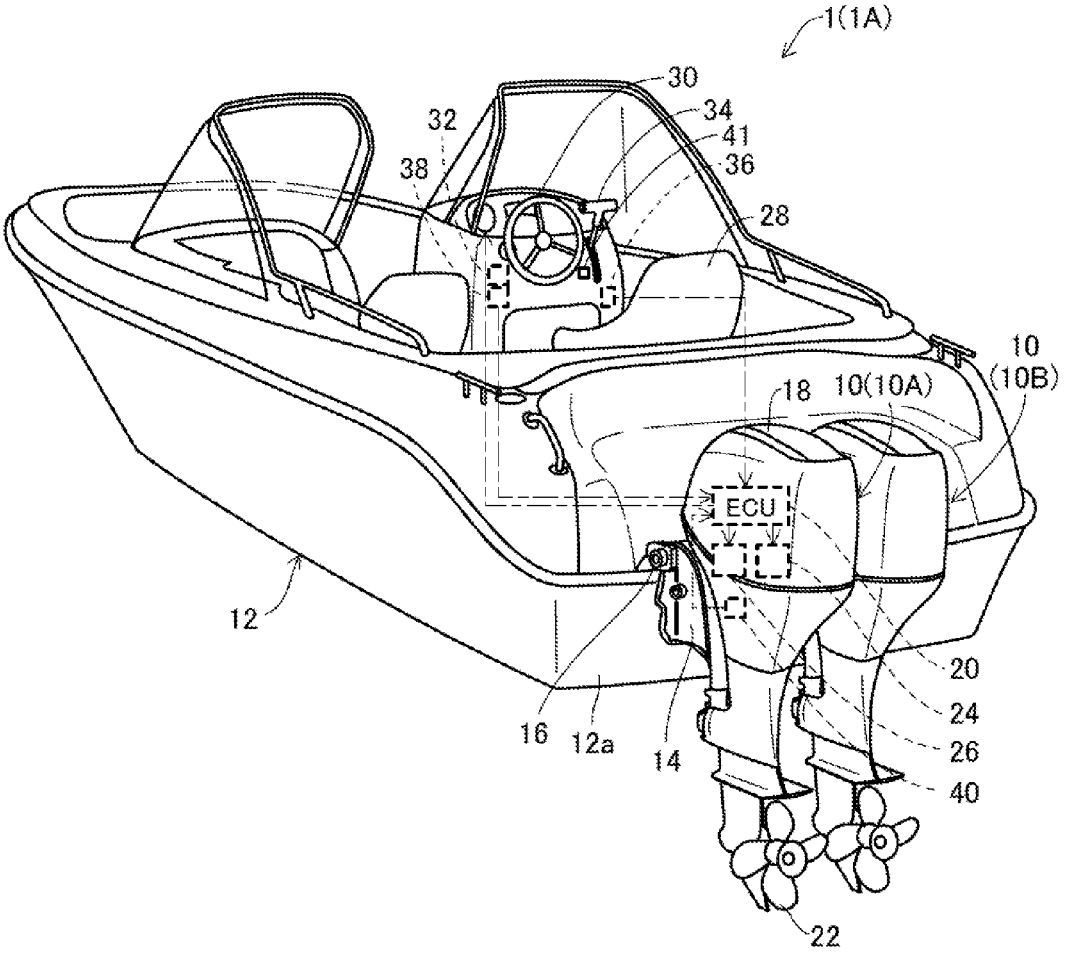
FIG. 1 is an overall schematic view of an outboard motors installed on a boat to which an outboard motor control apparatus according to a first and a third embodiment of the invention is applied.

FIG. 1 is an overall schematic view of outboard motors installed on a boat according to the first and a third embodiment.

In FIG. 1, symbol 1A indicates a boat 1A whose hull 12 is mounted with a plurality of outboard motors 10 side by side, specifically two outboard motors comprising an outboard motor 10A installed at the port side (left-hand side as the operator faces forward toward the bow; hereinafter referred to as "first outboard motor"), and an outboard motor 10B installed at the starboard side (right-hand side in that direction; hereinafter referred to as "second outboard motor"). Since the first and second outboard motors 10A and 10B have the same structure, they will generally be explained in the following as the outboard motors 10, unless otherwise mentioned.

As illustrated, the outboard motor 10 (10A) is clamped (fastened) to the stern or transom 12*a* of the hull 12, through stern brackets 14 and a tilting shaft 16.

The outboard motor 10 has an internal combustion engine (prime mover; not shown in FIG. 1) and an engine cover 18 that covers the engine. The engine cover 18 accommodates, in addition to the engine, in its interior space (engine room) an Electronic Control Unit (ECU) 20. The ECU 20 has a microcomputer constituted by a CPU, ROM, RAM and other devices, and functions as an outboard motor control apparatus for controlling the operation of the outboard motor 10.

The outboard motor 10 is provided with a transmission (automatic transmission) 24 that is installed at a drive shaft for transmitting the engine power to a propeller 22, and a power tilt/trim unit (hereinafter referred to as "trim unit") 26. The transmission 24 has a plurality of gears including the first and second speed gears and transmits the engine power through the selected gear to the propeller 22. The trim unit 26 is adapted to adjust a tilt/trim angle of the outboard motor 10 relative to the hull 12 by tilting up/down or trimming up/down. The operation of the transmission 24 and trim unit 26 is controlled by the ECU 20.

A steering wheel 30 is installed near a cockpit (operator's seat) 28 of the hull 12 to be rotatably manipulated by the operator. A steering angle sensor 32 is attached on a shaft (not shown) of the steering wheel 30 and produces an output or signal corresponding to the steering angle applied or inputted by the operator through the steering wheel 30.

A shift/throttle lever (shift lever) 34 is provided near the cockpit 28 to be manipulated by the operator. The shift/throttle lever 34 can be moved or swung in the front-back direction from the initial position and is used by the operator to input a shift instruction (switch instruction among forward, reverse and neutral) and an engine speed instruction.

A lever position sensor (shift/throttle lever position sensor) 36 is installed near the shift/throttle lever 34 and produces an output or signal corresponding to a position of the shift/throttle lever 34.

A GPS receiver 38 is provided at an appropriate location of the hull 12 to receive a Global Positioning System signal to produce an output or signal indicative of the positional information of the boat 1A obtained from the GPS signal.

In addition, a rudder angle sensor 40 is installed at an appropriate location and produces an output or signal indicative of a rudder angle $\alpha$ of the outboard motor 10 relative to the hull 12. Further, an auto spanker switch 41 is installed near the cockpit 28 to be manipulated by the operator. When the auto spanker switch 41 is made ON (manipulated) by the operator, it outputs a signal indicative of the instruction to conduct an auto spanker control (control to keep the navigation direction of the boat 1A constant) mentioned below. The outputs of the steering angle sensor 32, lever position sensor 36, GPS receiver 38, rudder angle sensor 40 and auto spanker switch 41 are sent to the ECU 20.

Figure 2:
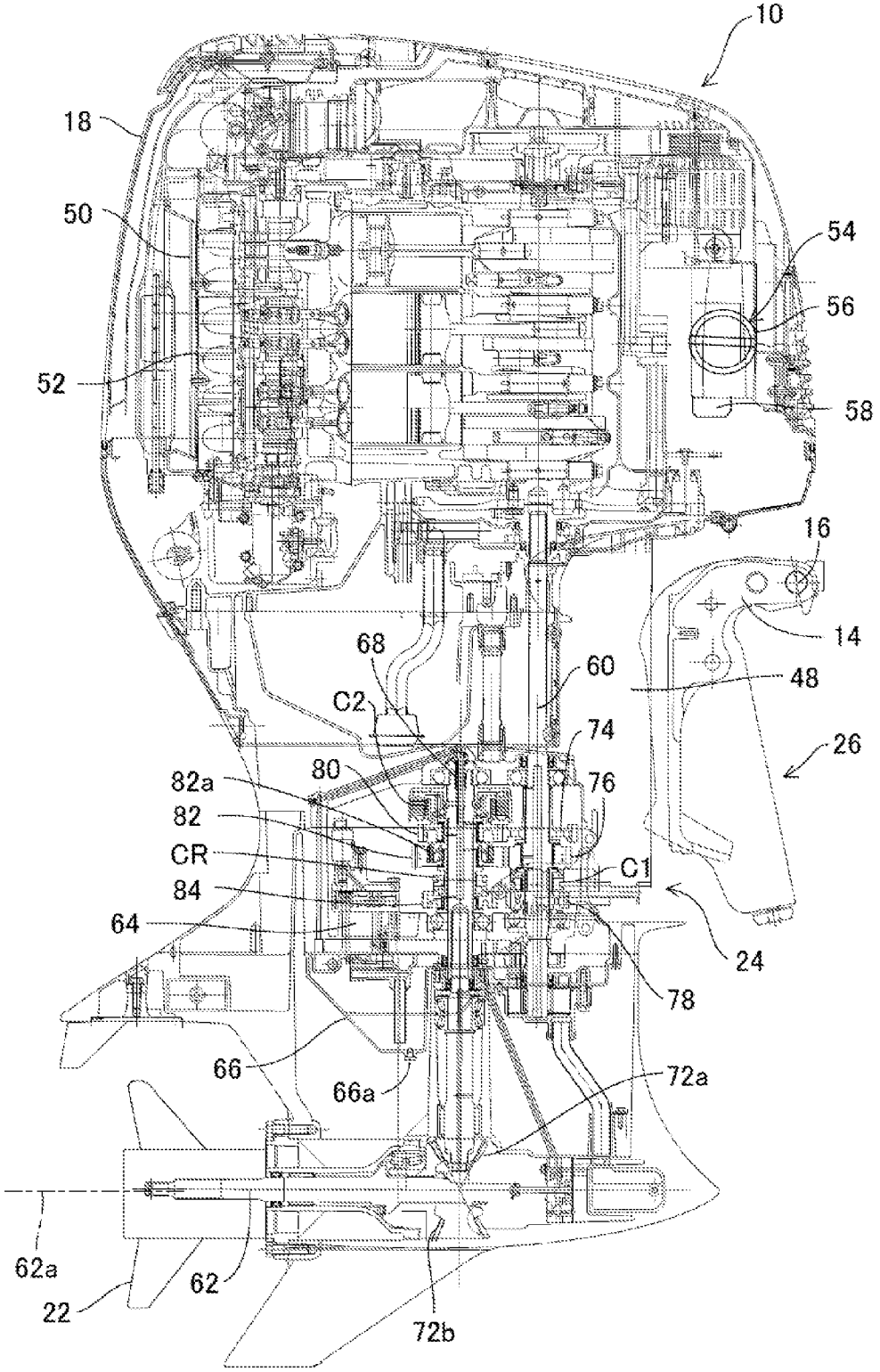
FIG. 2 is an enlarged sectional side view showing the outboard motor shown in FIG. 1.
Figure 3:
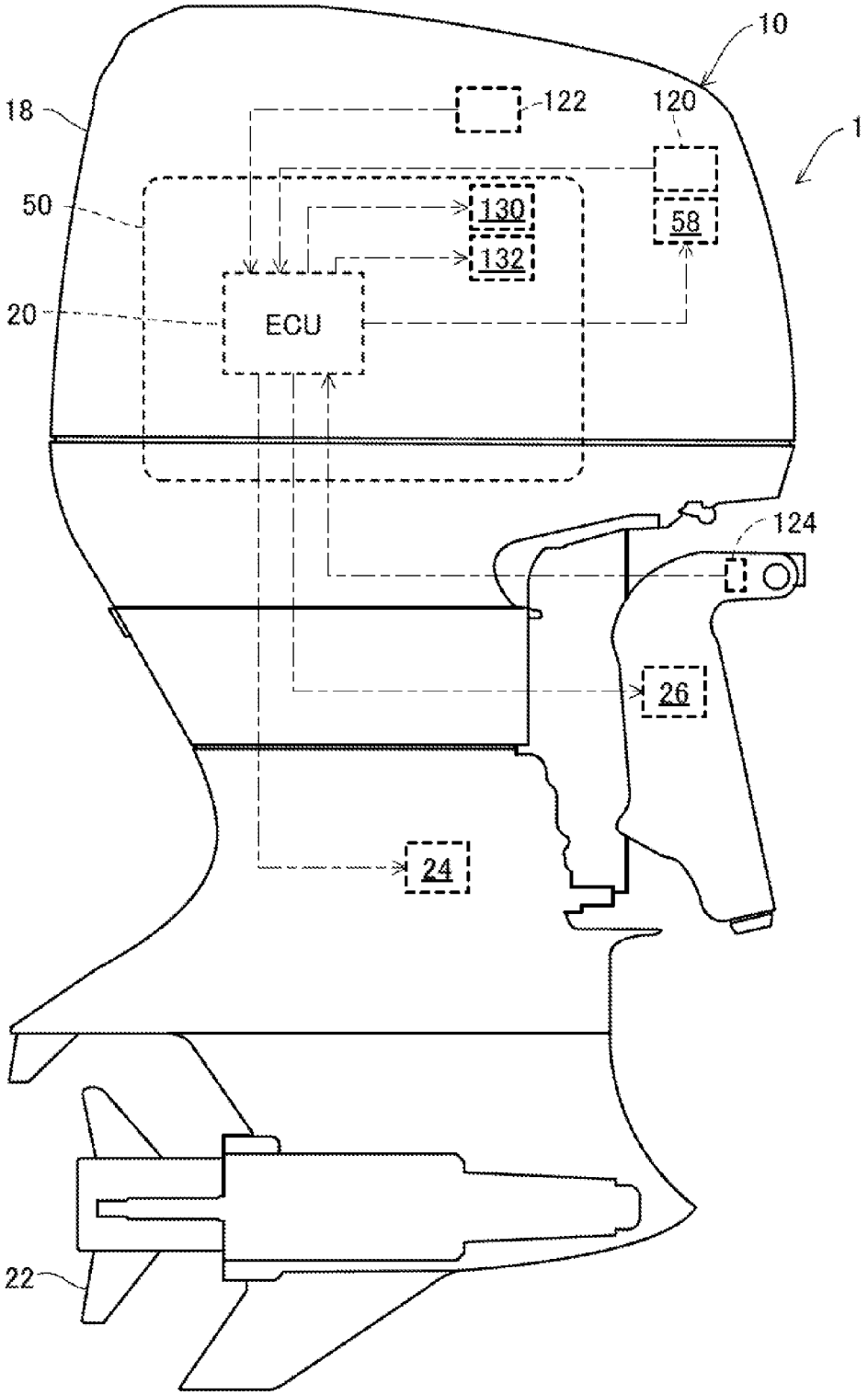
FIG. 3 is an enlarged side view of the outboard motor shown in FIG. 1.
Figure 4:
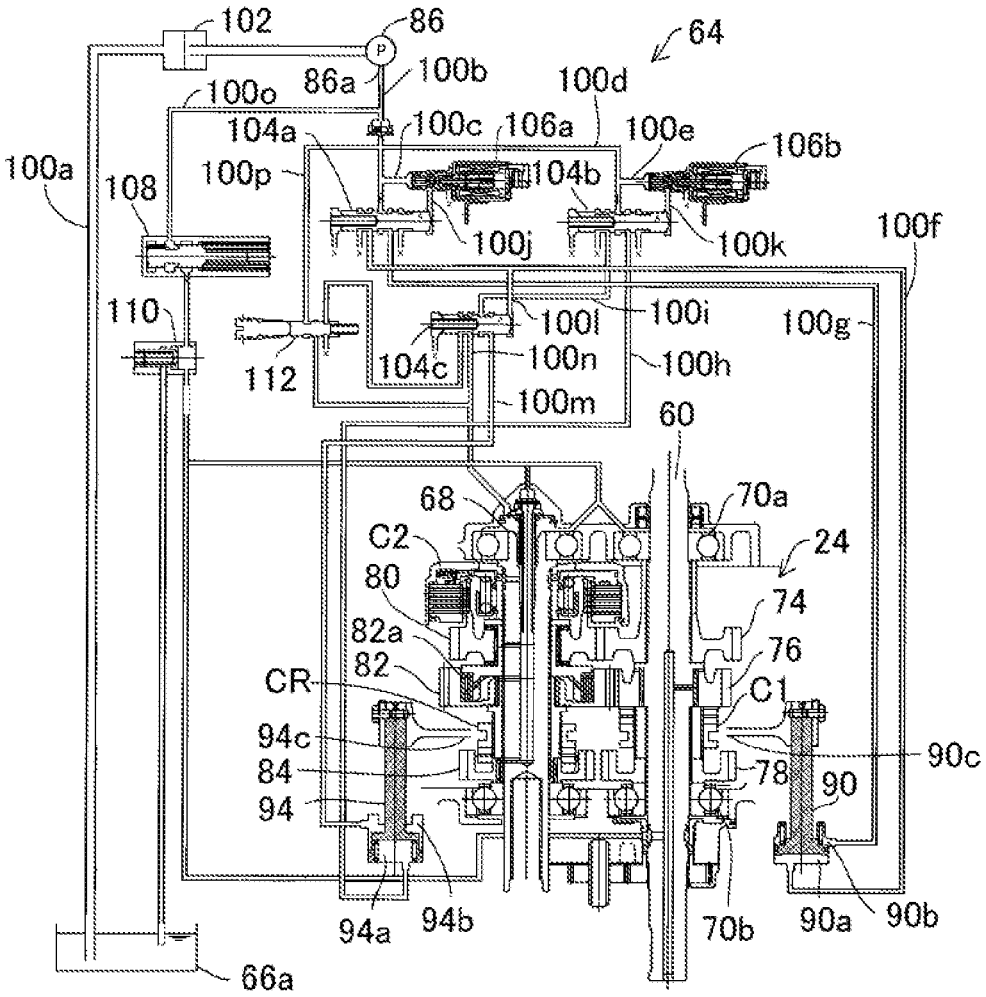
FIG. 4 is a hydraulic circuit diagram schematically showing a hydraulic circuit of a transmission mechanism shown in FIG. 2.

FIG. 2 is an enlarged sectional side view partially showing the outboard motor 10 shown in FIG. 1, FIG. 3 is an enlarged side view of the outboard motor 10 shown in FIG. 1, and FIG. 4 is a hydraulic circuit diagram schematically showing a hydraulic circuit of the transmission 24.

As shown in FIG. 2, the trim unit 26 is provided at a location close to the swivel case 48 and stern brackets 14. The trim unit 26 has a hydraulic cylinder for tilt angle adjustment, a hydraulic cylinder for trim angle adjustment and electric motors connected to respective hydraulic cylinders through a hydraulic circuit (neither shown). In the trim unit 26, the electric motors are driven by a tilting up/down signal or a trimming up/down signal sent from the ECU 20 to supply hydraulic oil (pressure) to the cylinder concerned so as to extend/contract the same. With this, the swivel case 48 is rotated about the tilting shaft 16 so that the outboard motor 10 is tilted up/down (and trimmed up/down) relative to the hull 12.

The outboard motor 10 is installed at its upper portion with the aforesaid engine (now assigned by symbol 50). The engine 50 comprises a spark-ignition, water-cooled, gasoline engine with a displacement of 2,200 cc. The engine 50 is located above the water surface, and is covered by the engine cover 18.

An air intake pipe 52 of the engine 50 is connected to a throttle body 54. The throttle body 54 has a throttle valve 56 installed therein and an electric throttle motor 58 for opening and closing the throttle valve 56 is integrally disposed thereto. An output shaft of the throttle motor 58 is connected to the throttle valve 56 via a speed reduction gear mechanism (not shown). The throttle motor 58 is operated to open and close the throttle valve 56, thereby regulating a flow rate of air sucked into the engine 50 to control the engine speed.

The outboard motor 10 is provided with a main shaft (input shaft; corresponding to the aforesaid drive shaft) 60 that is rotatably supported in parallel with a vertical axis and its upper end is connected to the crankshaft (not shown) of the engine 50, and a propeller shaft (the aforesaid drive shaft) 62 that is rotatably supported in parallel with a horizontal axis and its one end (the left end in FIG. 2) is connected to the propeller 22. The aforesaid transmission 24 having the first speed and second speed forward gears and the reverse gear is provided at a location between the main shaft 60 and the propeller shaft 62. The power of the engine 50 is transmitted to the propeller 22 through the main shaft 60, transmission 24 and the propeller shaft 62.

The propeller shaft 62 is fixed to the outboard motor 10 in such a manner that its axis 62*a* is substantially parallel to the forward direction of the boat 1A when the trim unit 26 is at its initial state, i.e., the trim angle is an initial angle (zero degree) in the forward movement of the boat 1A.

At a rear position of the transmission 24 in forward moving direction of the boat 1A (left of the transmission 24 in FIG. 2), there is provided a valve unit 64 comprising a plurality of hydraulic valves to be used to control the transmission 24.

The valve unit 64 and a part of the main shaft 60 is contained in a case 66, and the lower portion of the case 66 functions as an oil pan (reservoir) 66*a*.

As shown in FIGS. 2 and 4, the transmission 24 is constituted as a parallel-axis type conventional stepped gear ratio transmission comprising the aforesaid main shaft (input shaft) 60, a countershaft (output shaft) 68 disposed in parallel with the main shaft 60 and connected thereto through a plurality of gears. The main shaft 60 and countershaft 68 are each supported in the case 66 through a pair of bearings 70*a*, 70*b*.

The countershaft 68 is connected (coupled) to the propeller shaft 62 at its distal end (the lower end in FIG. 2) through a pinion gear 72*a* and a bevel gear 72*b*. The main shaft 60 is provided (from the top in FIG. 2) with a main second speed gear 74 irrotatably supported thereon, a main first speed gear 76 rotatably supported thereon, a first speed gear clutch (made of a mechanical dog clutch) C1 irrotatably but longitudinally movably supported thereon and a main reverse gear 78 irrotatably supported thereon, while the countershaft 68 is provided with a second speed gear clutch (made of a hydraulic clutch) C2 irrotatably but longitudinally movably supported thereon, a counter second speed gear 80 rotatably supported thereon and meshed with the main second speed gear 74, a counter first speed gear 82 irrotatably supported thereon and meshed with the main first speed gear 76, a reverse gear clutch (made of a mechanical dog clutch) CR irrotatably but longitudinally movably supported thereon and a counter reverse gear 84 rotatably supported thereto and meshed with the main reverse gear 78.

When the first speed gear clutch C1 is moved in one longitudinal direction, i.e., in the upper direction in the figure, for a predetermined distance, it coupled with the main first speed gear 76 and engages (fastens) the gear 76 on the main shaft 60 to establish the first speed.

When the second speed gear clutch C2 is supplied with the hydraulic oil (pressure) from a hydraulic oil pump 86 (driven by the engine 50), it engages (fastens) the counter second speed gear 80 on the countershaft 68 to establish the second speed.

When the reverse gear clutch CR is moved in one longitudinal direction, i.e., in the lower direction in the figure, for a predetermined distance, it coupled with the counter reverse gear 84 and engages (fastens) the counter reverse gear 84 on the countershaft 68 to establish the reverse.

The counter first speed gear 82 is installed with one-way clutch 82*a* that releases (decouples) the counter first speed gear 82 from the countershaft 68 when the rotational speed of the counter first speed gear 82 becomes equal to or greater than a predetermined rotational speed. In other words, while the rotational speed of the counter first speed gear 82 is relatively low, the power of the engine 50 is transmitted to the propeller 22 by the main first speed gear 76 and the counter first speed gear 82, but when the rotational speed increases and becomes equal to or greater than a predetermined rotational speed, the engagement of the counter first speed gear 82 and the shaft 68 is released by the one-way clutch 82*a*, and the power of the engine 50 is no longer transmitted to the propeller 22 by the main first speed gear 76 and the counter first speed gear 82.

As shown in FIG. 4, the first speed gear clutch C1 is connected to a first speed gear shift actuator 90 through a shift fork 90*c*. The first speed gear shift actuator 90 is a hydraulic actuator that can extend or contract and when it extends, it moves the first speed gear clutch C1 in a longitudinal direction of the main shaft 60, while, when it contracts, it move the clutch C1 in a direction opposite thereto. Specifically, it extends when the actuator 90 is supplied with the hydraulic oil in its oil chamber 90*a*, and it contracts when the actuator 90 is supplied with hydraulic oil in its oil chamber 90*b*.

The reverse gear clutch CR is connected to a reverse shift actuator 94 through the shift fork 94*c*. Similar to the first speed gear shift actuator 90, the reverse shift actuator 94 is also a hydraulic actuator that can extend or contract and when it extends, it moves the reverse gear clutch CR in a longitudinal direction of the countershaft 68, while, when it contracts, it move the clutch CR in a direction opposite thereto. Specifically, it contracts when the actuator 94 is supplied with the hydraulic oil in its oil chamber 94*b*, and it extends when the actuator 94 is supplied with the hydraulic oil in its oil chamber 94*a*.

A forward shift switch that produces a signal or output that indicates the coupling of the first speed gear clutch C1 with the main first speed gear 76 when the first speed gear shift actuator 90 is moved for a predetermined distance, and a reverse shift switch that produces a signal or output that indicates the coupling of the reverse gear clutch CR with the counter reverse gear 84 when the reverse shift actuator 94 is moved for a predetermined distance, are installed near the transmission 24 (neither shown).

When the main first speed gear 76 rotatably supported on the main shaft 60 is engaged on the main shaft 60 by the first speed gear clutch C1, the output of the engine 50 is transmitted to the propeller 22 via the main shaft 60, the main first speed gear 76, the counter first speed gear 82 and the countershaft 68 so that the first speed is established.

Alternatively, when the counter second speed gear 80 rotatably supported on the countershaft 68 is engaged on the countershaft 68 by the second speed gear clutch C2 while the first speed gear clutch C1 has been coupled with the main first speed gear 76 (during which the reverse gear clutch CR is at a neutral position), the output of the engine 50 is transmitted to the propeller 22 via the main shaft 60, the main second speed gear 74 irrotatably supported on the main shaft 60, the counter second speed gear 80 and the countershaft 68 so that the second speed is established.

Further, when the counter reverse gear 84 rotatably supported on the countershaft 68 is engaged on the countershaft 68 by the reverse gear clutch CR, the output of the engine 50 is transmitted to the propeller 22 via the main shaft 60, the main reverse gear 78 irrotatably supported on the main shaft 60, the counter reverse gear 84 and the countershaft 68 so that the reverse is established.

Furthermore, when the first speed gear shift actuator 90 contracts whereas the reverse shift actuator 94 extends so that the first speed gear clutch C1 and the reverse gear clutch CR are at their neutral position (at that time the second speed gear clutch C2 is not engaged with the counter second speed gear 80), the main shaft 60 and the countershaft 68 are not coupled together so that the neutral position is established.

Thus, the engagement of the gears and the shafts 60, 68 by the first speed gear clutch C1, the second speed gear clutch C2 and the reverse gear clutch CR is conducted by controlling the hydraulic pressure to be supplied from the oil pump 86 to the clutches C1, C2 and CR.

Explaining this in detail, the oil pump 86 driven by the engine 50 pumps the hydraulic oil retained in the oil pan 66*a* through an oil passage 100*a* via strainer 102 and discharges pressurized hydraulic oil from an outlet 86*a*. The pressurized hydraulic oil discharged from the outlet 86*a* is supplied on the one hand to a first switch valve 104*a* through an oil passages 100*b* and to a second switch valve 104*b* through an oil passage 100*d*, and is supplied on the other hand to a first electromagnetic solenoid (linear solenoid) valve (hereinafter referred to as "first electromagnetic valve") 106*a* through an oil passage 100*c* branched off from the oil passage 100*b* and to a second electromagnetic solenoid (linear solenoid) valve (hereinafter referred to as "second electromagnetic valve") 106*b* through an oil passage 100*e* branched off from the oil passage 100*d*.

The first switch valve 104*a* is installed at the junction of the aforesaid oil passage 100*b* and other oil passages 100*f*, 100*g* connecting the oil pump 86 to the first speed gear shift actuator 90. Specifically, the first switch valve 104*a* is connected to an oil chamber 90*a* of the first speed gear shift actuator 90 through the oil passage 100*f*, and is connected to an oil chamber 90*b* of the actuator 90 through the oil passage 100*g*.

The second switch valve 104*b* is installed at the junction of the aforesaid oil passages 100*b*, 100*d* and other oil passages 100*h*, 100*i*, 100*m*, 100*n* connecting the oil pump 86 to the second speed gear clutch C2 and the reverse shift actuator 94. Specifically, the second switch valve 104*b* is connected to an oil chamber 94*a* of the reverse shift actuator 94 through the oil passage 100*h*, is connected to an oil chamber 94*b* of the actuator 94 through the oil passage 100*i*, 100*m*, and is connected to the second speed gear clutch C2 through the oil passage 100*i*, 100*n*.

The first and second switch valves 104*a*, 104*b* have spools that are displaceably stored therein. Each of the spools is provided with a spring at one end (left in the figure) that urges the spool toward the opposite (other) end, and is connected to the first or second electromagnetic valve 106*a* or 106*b* through the oil passage 100*j* or 100*k* at the opposite end.

When the first electromagnetic valve 106*a* is made ON (energized), its spool is displaced to connect the oil passages 100*c* and 100*j* and the hydraulic oil supplied from the oil pump 86 through the oil passage 100*c* is outputted to the opposite end of the spool of the first switch valve 104*a* through the oil passage 100*j*. With this, the spool of the first switch valve 104*a* is displaced toward the one end, and the hydraulic oil in the oil passage 100*b* flows to the oil passage 100*f* and to the oil chamber 90*a* of the first speed gear shift actuator 90.

On the other hand, when the first electromagnetic valve 106*a* is made OFF (de-energized), its spool is not displaced so that the oil passages 100*c* and 100*j* are not connected and the hydraulic oil of the oil passage 100*c* is not outputted to the opposite end of the spool of the first switch valve 104*a*. Accordingly, the spool of the first switch valve 104*a* is kept urged toward the opposite end by the spring, and hence, the hydraulic oil in the oil passage 100*b* flows to the oil passage 100*g* and to the oil chamber 90*b* of the first speed gear shift actuator 90.

Similar to the first electromagnetic valve 106*a*, when the second electromagnetic valve 106*b* is made ON, its spool is displaced to connect the oil passages 100*e* and 100*k*. With this, the spool of the second switch valve 104*b* is displaced toward the one end and the hydraulic oil in the oil passage 100*d* flows to the oil passage 100*i* and to a third switch valve 104*c*.

On the other hand, when the second electromagnetic valve 106*b* is made OFF, its spool is not displaced so that the hydraulic oil of the oil passage 100*e* is not applied to the opposite end of the spool of the first switch valve 104*b* and its spool is kept urged toward the opposite end by the spring. Accordingly, the hydraulic oil of the oil passage 100*d* is supplied to the oil chamber 94*a* of the reverse shift actuator 94 through the oil passage 100*h*.

The third switch valve 104*c* is installed at the junction of the aforesaid oil passages 100*i*, 100*m*, 100*n* connecting the second switch valve 104*b* to the reverse shift actuator 94 or the second speed gear clutch C2. Specifically, the third switch valve 104*c* is connected to the oil chamber 94*b* of the reverse shift actuator 94 through the oil passage 100*m*, and is connected to the second speed gear clutch C2 through the oil passage 100*n*.

The third switch valve 104*c* has a spool that is displaceably stored therein. The spool is provided with a spring at one end (left in the figure) that urges the spool toward the opposite end, and is connected to an oil passage 100*l* at the opposite end. Accordingly, when the first electromagnetic valve 106*a* is made ON and the spool on the first switch valve 104*a* is displaced toward the one end to discharge the hydraulic oil in the oil passage 100*b* to the oil passage 100*f*, a part of the hydraulic oil is outputted to the opposite end of the third switch valve 104*c* through the oil passage 100*l*. With this, the spool of the third switch valve 104*c* is displaced toward the one end, and the hydraulic oil in the oil passage 100*i* flows to the second speed gear clutch C2 through the oil passage 100*n* so that the second speed gear clutch C2 is engaged with the counter second speed gear 80.

On the other hand, when the first electromagnetic valve 106*a* is made OFF, the spool of the first switch valve 104*a* is not displaced so that the hydraulic oil in the oil passage 100*l* is not applied to the opposite end of the third switch valve 104*c*. Accordingly, the spool of the third switch valve 104*c* is kept urged toward the other end and hence, the hydraulic oil from the oil passage 100*i* flows to the oil passage 100*m* and to the oil chamber 94*b* of the reverse shift actuator 94.

As mentioned above, when the first electromagnetic valve 106*a* is made ON but the second electromagnetic valve 106*b* is made OFF, the first speed gear shift actuator 90 is supplied with the hydraulic oil in its oil chamber 90*a*, while the second speed gear clutch C2 is not supplied with the hydraulic oil, the main first speed gear 76 is engaged on the main shaft 60 by the first speed gear clutch C1, so that the first speed is established. At this time, since the reverse shift actuator 94 is supplied with the hydraulic oil in its oil chamber 94*a* and extends, the reverse gear clutch CR is not engaged with the counter reverse gear 84 and is at the neutral position.

When the first and second electromagnetic valves 106*a* and 106*b* are made ON, since the oil chamber 90*a* of the first speed gear shift actuator 90 and the second speed gear clutch C2 are supplied with the hydraulic oil, the main first speed gear 76 is engaged on the main shaft 60 by the first speed gear clutch C1 and the counter second speed gear 80 is engaged on the countershaft 68 by the second speed gear clutch C2, so that the second speed is established.

When the first electromagnetic valve 106*a* is made OFF but the second electromagnetic valve 106*b* is made ON, since the first speed gear shift actuator 90 is supplied with the hydraulic oil in its chamber 90*b*, the reverse shift actuator 94 is supplied with the hydraulic oil in its oil chamber 94*b*, but the second speed gear clutch C2 is not supplied with the hydraulic oil, the counter reverse gear 84 is engaged on the countershaft 68 by the reverse gear clutch CR, so that the reverse is established.

When the first and second electromagnetic valves 106*a* and 106*b* are made OFF, since the first speed gear shift actuator 90 and reverse shift actuator 94 are supplied with the hydraulic oil in their oil chambers 90*b*, 94*a*, the first speed gear clutch C1 and reverse gear clutch CR are at their neutral positions. And since the second speed gear clutch C2 is not supplied with the hydraulic oil, the main shaft 60 and the countershaft 68 are not engaged together and hence, become neutral.

The hydraulic oil pressurized by the oil pump 86 is supplied to lubricant-requiring portions such as the main shaft 60, the countershaft 68, etc., through the oil passage 100*b*, an oil passage 100*o*, a regulator valve 108 and a relief valve 110.

An emergency valve 112 is provided at an oil passage 100*p* that bypasses the first switch valve 104*a*, first electromagnetic valve 106*a* and third switch valve 104*c*. The emergency valve 112 comprises a manually operated valve that allows the user shift gears in case of emergency.

Returning to the explanation of FIG. 3, a throttle opening sensor 120 is installed near the throttle valve 56 to produce an output or signal indicative of throttle opening TH of the throttle valve 56. A crank angle sensor (engine speed detector) 122 is installed near the crankshaft of the engine 50 and produces a pulse signal at every predetermined crank angle. A trim angle sensor 124 is installed near the tilting shaft 16 and produces an output or signal corresponding to a trim angle θ of the outboard motor 10.

The outputs of the sensors 120, 122, 124 are sent to the ECU 20. The ECU 20 and the sensors including those mentioned above (the steering angle sensor 32, etc.,) and the GPS receiver 38 are connected through a standard communication such as authorized by the National Marine Electronics Association, more specifically Controller Area Network.

The ECU 20 conducts a shift control of the transmission 24 and a trim angle control to control the trim angle θ of the trim unit 26. The ECU 20 also conducts throttle opening control to open/close the throttle valve 56 regulating the throttle opening TH by controlling the operation of the electric throttle motor 58 based on the output of the lever position sensor 36.

Further, the ECU 20 controls fuel injection and ignition timing of the engine 50 based on inputted sensor outputs, supplies fuel controlled thereof through injectors 130, and ignites air-fuel mixture of the injected fuel and intake air at the ignition timing controlled thereof through ignition system 132.

As mentioned above, the control apparatus for the outboard motor 10 according to this embodiment is constituted as a Drive-By-Wire fashion in which the mechanical connection between the operation system (including the steering wheel 30 and shift/throttle lever 34) and the outboard motor 10 is cut out.

Figure 5:
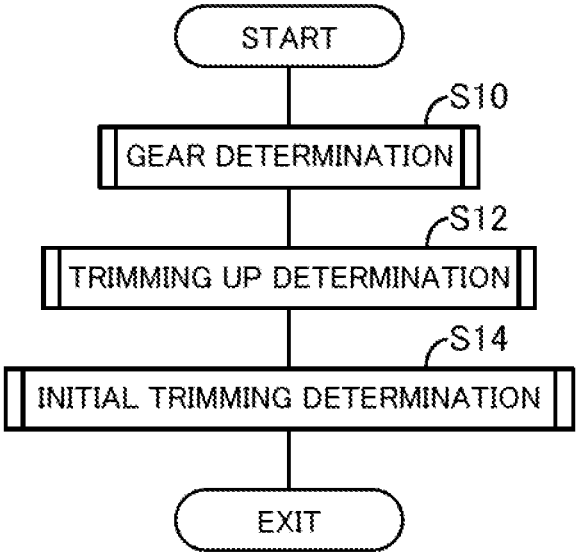
FIG. 5 is a flowchart showing a shift control operation and a trim angle control operation of the outboard motor control apparatus conducted by an Electronic Control Unit of outboard motors illustrated in FIG. 1.

FIG. 5 is a flowchart showing a shift control operation and the trim angle control operation of the ECU 20. The illustrated program is executed by the ECU 20 at predetermined intervals, e.g., 100 milliseconds.

The program begins at S10, in which it is determined which speed of the transmission 24 should be selected from among the first speed and the second speed when the gear shift is forward (S: processing step).

Figure 6:
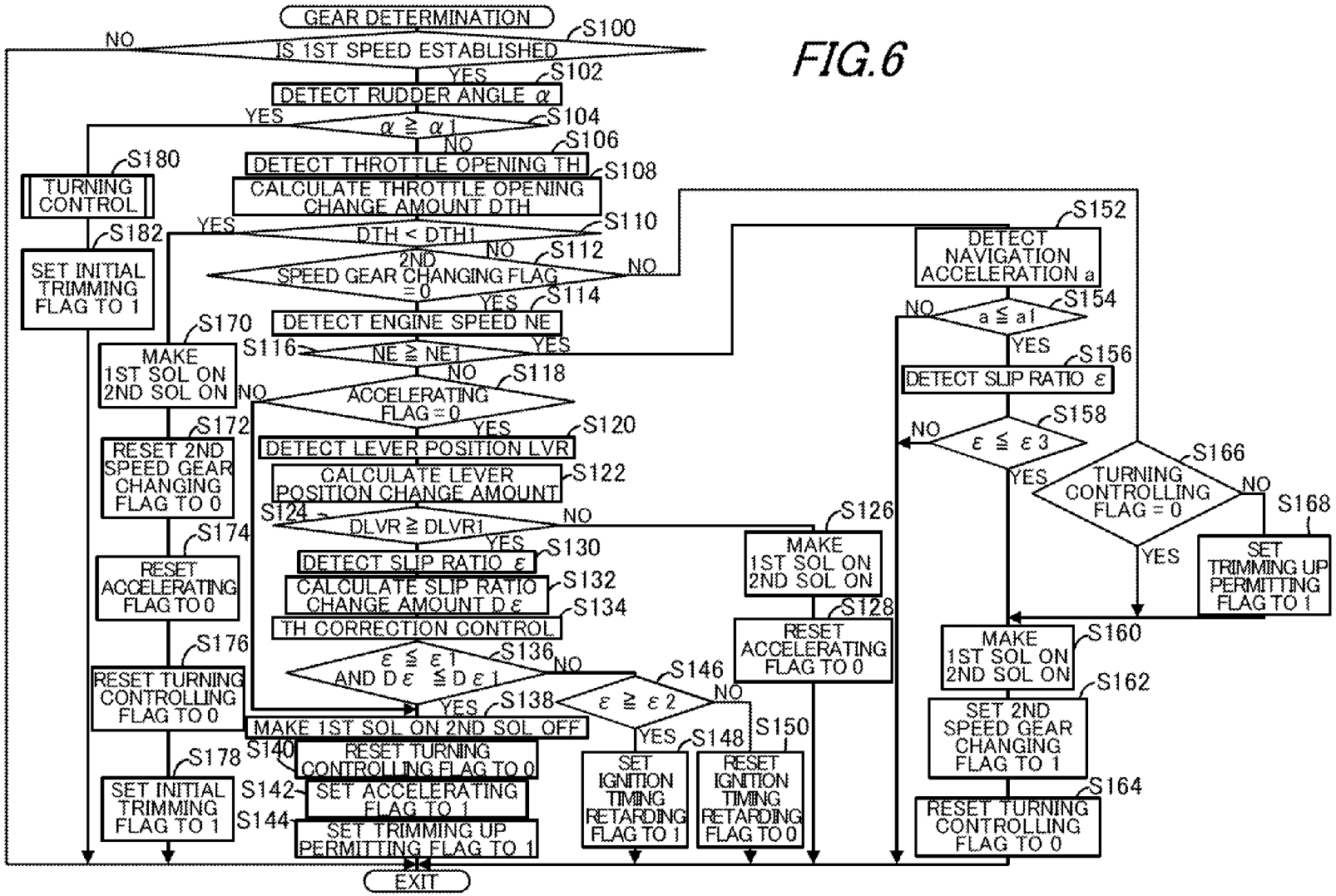
FIG. 6 is a flowchart showing the subroutine of a gear determination step shown in FIG. 5.

FIG. 6 is a flowchart showing the subroutine of the gear determination in S10. The program begins at S100, in which it is determined whether the first speed gear clutch C1 is engaged on the main first speed gear 76 and the first speed is established based on the output value of the forward shift switch and the reverse shift switch.

When the result in S100 is negative, the program skips the following processing. When the result in S100 is affirmative, the program proceeds to S102, in which a rudder angle α of the outboard motor 10 relative to the hull 12 is detected based on the output value of the rudder angle sensor 40.

The program next proceeds to S104, in which it is determined whether the detected rudder angle α is equal to or greater than a predetermined first angle α1, e.g., 15 degrees. The result in S104 is naturally negative in the first program loop and the program proceeds to S106, in which the throttle opening TH is detected from the output value of the throttle opening sensor 120, and to S108, in which an amount of change in the detected throttle opening TH per unit time (e.g., 500 milliseconds) DTH is calculated.

The program next proceeds to S110, in which it is determined whether the amount of change DTH is smaller than a predetermined first value DTH1 that is set to be a negative value, e.g., −0.5 degrees, in other words it is determined whether it is in an operating condition in which the engine 50 is instructed by the operator to decelerate the navigation boat 1AA.

When the result in S110 is negative, the program proceeds to S112, in which it is determined whether the bit of a second speed gear changing flag is 0. As mentioned below, the bit of the flag is set to 1 when the gear is changed (shifted) from the first speed to the second speed after completion of acceleration.

Since an initial value of the bit of the second speed gear changing flag is 0, the result in S112 is naturally affirmative in the first program loop and the program proceeds to S114, in which the engine speed NE is detected by measuring a time period between intervals of the outputted pulses of the crank angle sensor 122.

The program next proceeds to S116, in which it is determined whether the detected engine speed NE is equal to or greater than a predetermined first engine speed NE1 mentioned below.

Since the engine speed NE in the program loop immediately after starting the engine is generally smaller than the predetermined first engine speed NE1, the result in S116 is normally negative and the program proceeds to S118, in which it is determined whether the bit of an accelerating flag mentioned below is 0. Since an initial value of the bit of the accelerating flag is also 0, the result in S118 is naturally affirmative in the first program loop and the program proceeds to S120, in which a lever position LVR of the shift/throttle lever 34 is detected from the output value of the lever position sensor 36.

The program then proceeds to S122, in which an amount of change in the lever position LVR of the shift/throttle lever 34 in the opening direction of the throttle valve 56 per unit time (e.g., 500 milliseconds) DLVR is calculated.

The program next proceeds to S124, in which it is determined whether the amount of change DLVR is equal to or greater than a predetermined first value DLVR1, in other words it is determined whether it is in an operating condition in which the engine 50 is instructed by the operator to accelerate (to be precise, rapidly accelerate) the boat 1A. Accordingly, the predetermined first value DLVR1 is set to a threshold value that enables to determine whether the engine 50 is instructed to accelerate, for example to 0.5 degrees.

When the result in S124 is negative, the program proceeds to S126, in which the first and second electromagnetic valves 106*a* and 106*b* (shown as "1ST SOL" and "2ND SOL") are made ON to shift (change) the gear to the second speed, and to S128, in which the bit of the accelerating flag is reset to 0.

On the other hand, when the result in S124 is affirmative, specifically the engine 50 is instructed to accelerate, the program proceeds to S130, in which a slip ratio ϵ indicating the rotating state of the propeller 22 is detected (calculated), and to S132, in which an amount of change in the slip ratio ϵ per unit time (e.g., 500 milliseconds) Dϵ is calculated. The slip ratio ϵ is calculated based on a theoretical navigation speed Va and an actual (detected) navigation speed V of the boat 1A, specifically using a following equation (1).

$$\text{Slip ratio } \epsilon = \text{Theoretical navigation speed } Va(\text{km/h}) - (\text{Detected navigation speed } V(\text{km/h}))/(\text{Theoretical navigation speed } Va(\text{km/h})) \quad (1)$$

In the equation (1), the actual navigation speed V is detected or calculated from the outputs of the GPS receiver 38 (positional information). The theoretical navigation speed Va is calculated based on the operating conditions of the engine 50 or the transmission 24 and the specifications of the propeller 22 using a following equation (2).

$$\text{Theoretical navigation speed } Va(\text{km/h}) = (\text{Engine speed } NE(\text{rpm}) - \text{Propeller pitch (inches)} \times 60 \times 2.54 \times 10^{-5})/(\text{Transmission gear ratio}) \quad (2)$$

In the equation (2), the propeller pitch indicates a theoretical distance that the boat 1A advances during one revolution of the propeller 22, and the transmission gear ratio indicates the gear ratio of the transmission selected in the transmission 24 at that time, and is 1.9 when it is in the second speed gear, for example. The value 60 is a factor to be used to convert the engine speed NE from revolutions per minute to an hourly value. The value $2.54\times10^{-5}$ is a factor to be used to convert the propeller pitch from inches to kilometers.

The program next proceeds to S134, in which the throttle opening TH of the engine 50 is controlled to suppress increase of the slip ratio ϵ of the propeller 22 (shown as "TH CORRECTION CONTROL").

The program next proceeds to S136, in which it is determined whether the slip ratio ϵ is equal to or smaller than a predetermined first slip ratio ϵ1 and the amount of change in the slip ratio ϵ (Dϵ) is equal to or smaller than a predetermined first amount of change in the slip ratio (Dϵ1). The predetermined first slip ratio ϵ1 is set to a threshold value that enables to determine whether the grip force is relatively large, for example to 0.3. The predetermined first amount of change in the slip ratio Dϵ1 is set to 0, for example. Specifically, the processing in S136 is to determine whether the slip ratio ϵ decreases and the grip force becomes larger.

When the result in S136 is affirmative, the program proceeds to S138, in which the first electromagnetic valve 106*a* is made ON and the second electromagnetic valve 106*b* is made OFF to change the gear from the second speed to the first speed (shift down). With this, the output torque of the engine 50 is amplified or increased by shifting down to the first speed, and is transmitted to the propeller 22, and enhances the acceleration performance.

The program next proceeds to S140, in which the bit of the turning controlling flag is reset to 0. The bit of the turning controlling flag is set to 1 when the turning control mentioned below is conducted.

The program next proceeds to S142, in which the bit of the accelerating flag is set to 1, and to S144, in which the bit of the trimming up permitting flag (initial value is 0) is set to 1. The bit of the accelerating flag is set to 1 when the gear is changed or shifted from the second speed to the first speed after it was determined that the engine 50 was instructed to accelerate. Once the bit of this flag is set to 1, since the result in S118 becomes negative in subsequent program loops, the program skips the processing in steps from S120 to S136. Setting the bit of the trimming up permitting flag to 1 means that the execution of the trimming up is permitted, and setting it to 0 means that there is no need to conduct trimming up, for example the deceleration instruction is given to the engine 50.

When the result in S136 is negative, specifically when the slip ratio ϵ becomes greater than the predetermined first slip ratio ϵ1 and the amount of change in the slip ratio Dϵ becomes greater than the predetermined first amount of change in the slip ratio Dϵ1, the program proceeds to S146, in which it is determined whether the slip ratio ϵ is equal to or greater than the predetermined second slip ratio ϵ2 set higher than the predetermined first slip ratio ϵ1. The predetermined second slip ratio ϵ2 is set to a threshold value that enables to determine whether the grip force is weak, for example to 0.5. Specifically, the processing in S146 is to determine whether the slip ratio ϵ increases and the grip force becomes weaker even though the throttle opening TH is corrected in S134.

When the result in S146 is affirmative, the program proceeds to S148, in which the bit of an ignition timing retarding flag (initial value is 0) is set to 1. When the bit of this flag is set to 1, the control to retard the ignition timing of the engine 50 is to be conducted in another program (not shown). In other words, the ignition timing to be calculated based on the engine speed NE and the like is retarded by predetermined degrees (e.g., 5 degrees) to reduce the power of the engine 50.

After reducing the power of the engine 50, the grip force of the propeller 22 increases momentarily and the slip ratio ϵ decreases to become smaller than the predetermined second slip ratio ϵ2. At that time, the result in S146 becomes negative and the program proceeds to S150, in which the bit of the ignition timing retarding flag is reset to 0, the control to retard the ignition timing of the engine 50 is terminated and normal ignition timing control is resumed.

Now, when the gear is changed to the first speed in S138, the engine speed NE increases and becomes equal to or greater than the predetermined first engine speed NE1 in S116. With this, the result in S116 becomes affirmative in subsequent program loops, and the program proceeds to S152, in which navigation acceleration $\underline{a}$ ($m/s^2$) indicating of an amount of change in the navigation speed V per unit time is detected based on the outputs of the GPS receiver 38. Since the processing in S116 is to determine whether the acceleration is coming to an end (acceleration is saturated), the predetermined first engine speed NE1 should be set to relatively high value (e.g., 5000 rpm).

The program next proceeds to S154, in which it is determined whether the detected navigation acceleration á is equal to or smaller than a predetermined first value a1, specifically it is determined whether the acceleration by amplifying or increasing the output torque of the engine at the first speed is completed. When the result in S154 is negative, the program is immediately terminated. But if the result in S154 is affirmative, the program proceeds to S156, in which the slip ratio ϵ of the propeller 22 is detected or calculated using the equations (1) (2) like in S130.

The program next proceeds to S158, in which it is determined whether the detected slip ratio ϵ is equal to or smaller than a predetermined third slip ratio ϵ3. The predetermined third slip ratio ϵ3 is set to a threshold value that is small enough to enable to determine whether the grip force is relatively large, for example to 0.3. Therefore, the processing in S158 is to determine whether the grip force of the propeller 22 is relatively large.

When the result in S158 is negative, the program terminates the processing, but when the result in S158 is affirmative, the program proceeds to S160, in which the first and second electromagnetic valves 106*a* and 106*b* are made ON to change the gear from the first speed to the second speed (shift up), and to S162, in which the bit of the second speed gear changing flag is set to 1. Further, the program proceeds to S164, in which the bit of the turning controlling flag is reset to 0.

Once the bit of the second speed gear changing flag is set to 1 in S162, since the result in S112 becomes negative in subsequent program loops, the program proceeds to S166. In S166, it is determined whether the bit of the turning controlling flag is 0. When the result in S166 is affirmative, the program proceeds to S160, but when the result in S166 is negative, program proceeds to S168, in which the bit of the trimming up permitting flag is set to 1.

When the result in S110 is affirmative, specifically when the amount of change in the throttle opening DTH is smaller than a predetermined first value DTH1, in other words when the operator instructs the engine 50 to decelerate, the program proceeds to S170, in which the first and second electromagnetic valves 106*a* and 106*b* are made ON to change the gear to the second speed. Then, the program proceeds to S172, S174, S176, in which the bits of the second speed gear changing flag, the accelerating flag, and the turning controlling flag are reset to 0, and to S178, in which the bit of the initial trimming flag (initial value is 0) is set to 1.

Setting the bit of the initial trimming flag to 1 means that the execution of trimming down described below is permitted and setting it to 0 means that there is no need to conduct trimming down.

Further, when the result in S104 is affirmative, specifically when the detected rudder angle $\alpha$ is determined to be equal to or greater than the predetermined first angle $\alpha 1$, the program proceeds to S180, in which the turning control is conducted.

Figure 7:
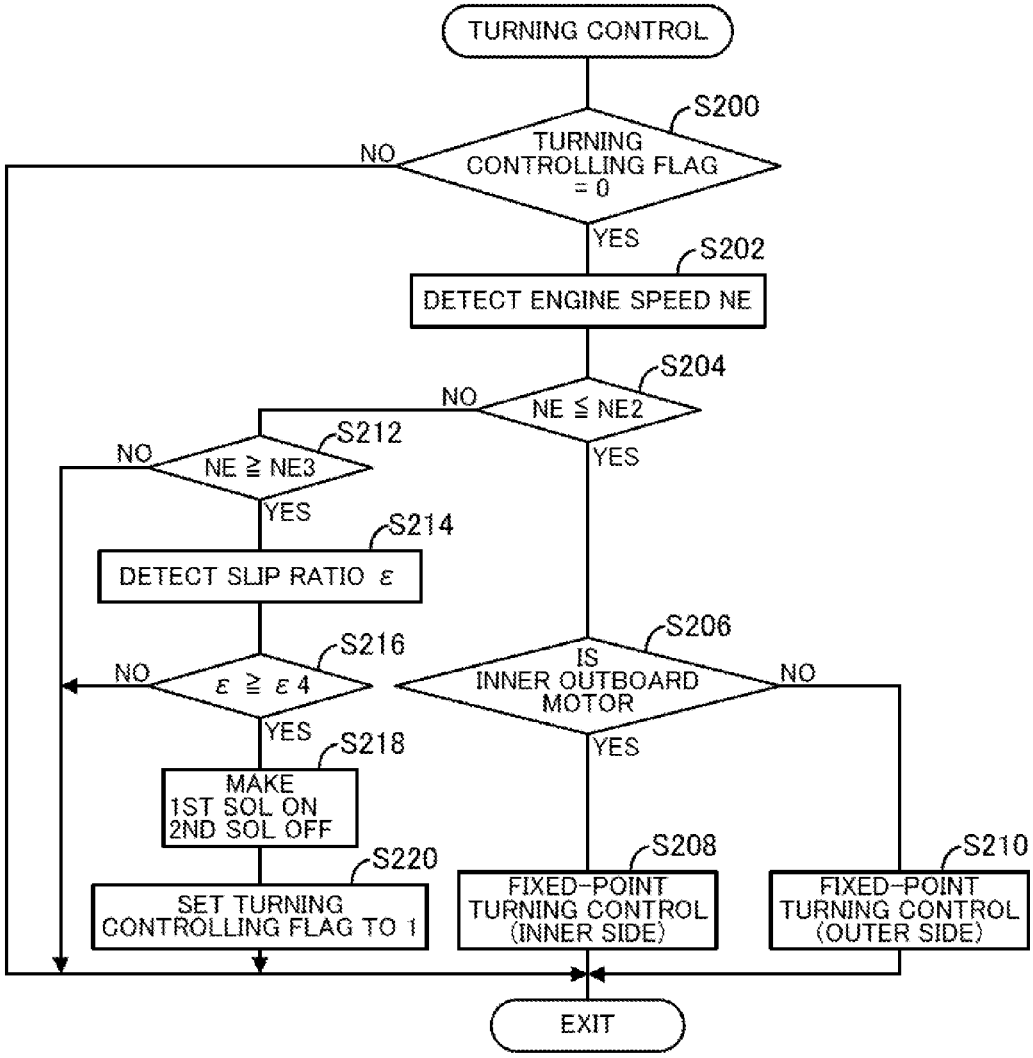
FIG. 7 is a flowchart showing the subroutine of a turning control operation shown in FIG. 6.

FIG. 7 is a flowchart showing the subroutine of the turning control in S180. The program begins at S200, in which it is determined whether the bit of the turning controlling flag is 0. When the result in S200 is negative, the program skips the following processing. When the result in S200 is affirmative, the program proceeds to S202, in which the engine speed NE is detected.

The program next proceeds to S204, in which it is determined whether the engine speed NE is equal to or smaller than a predetermined second engine speed NE2 (e.g., 800 rpm). When the result in S204 is affirmative, specifically when the engine speed NE is nearly equal to an idling engine speed, the program proceeds to the following processing from S206 to conduct fixed-point turning.

In S206, it is determined whether the outboard motor under control is an outboard motor 10 situated at an inner side at turning of the boat 1A, in other words it is determined which outboard motor, the first outboard motor 10A or the second outboard motor 10B, is the outboard motor 10 situated at the inner side at turning of the boat 1A, from the rudder angle $\alpha$. Specifically, the rudder angle $\alpha$ is detected, and when it is determined that the boat 1A turned counterclockwise from the detected rudder angle $\alpha$, the first outboard motor 10A situated at the left-hand side as the operator faces forward toward the bow is set as the outboard motor 10 situated at the inner side at turning of the boat 1A, and the second outboard motor 10B situated at the right-hand side in that direction is set as the outboard motor 10 situated at an outer side at turning of the boat 1A.

On the other hand, when the boat 1A is determined to be turning clockwise from the rudder angle $\alpha$, the second outboard motor 10B situated at the right-hand side as the operator faces forward toward the bow is set as the outboard motor 10 situated at the inner side at turning of the boat 1A, and the first outboard motor 10A situated at the left-hand side in that direction is set as the outboard motor 10 situated at the outer side at turning of the boat 1A.

When the result in S206 is affirmative, specifically when the outboard motor under control is determined to be an outboard motor 10 situated at the inner side at turning of the boat 1A, the program proceeds to S208, in which the fixed-point turning control for outboard motor 10 situated at the inner side at turning of the boat 1A is conducted. When the result in S206 is negative, specifically when the outboard motor under control is determined to be an outboard motor 10 situated at the outer side at turning of the boat 1A, the program proceeds to S210, in which the fixed-point turning control for outboard motor 10 situated at the outer side at turning of the boat 1A is conducted.

The fixed-point turning control for outboard motor 10 situated at the inner side at turning of the boat 1A (S208) is to control the operation of the transmission 24 to change the gear to the reverse, and the fixed-point turning control for outboard motor 10 situated at the outer side at turning of the boat 1A (S210) is to control the operation of the transmission 24 to change the gear to the first speed. These controls enable smooth fixed-point turning of the boat 1A.

Further, when the result in S204 is negative, specifically when the engine speed NE is greater than the predetermined second engine speed NE2, the program proceeds to S212, in which it is determined whether the engine speed NE is equal to or greater than the predetermined third engine speed NE3 (predetermined engine speed). Since S212 is a processing to determine whether the boat 1A is turning near the maximum navigation speed of the boat, the predetermined third engine speed NE3 is set to, for example, 5000 rpm.

When the result in S212 is negative, the program skips the following processing, but when the result in S212 is affirmative, the program proceeds to S214, in which the slip ratio $\epsilon$ of the propeller 22 is detected.

The program next proceeds to S216, in which it is determined whether the detected slip ratio $\epsilon$ is equal to or greater than the predetermined fourth slip ratio $\epsilon 4$ (predetermined slip ratio). When the result in S216 is negative, the program skips the following processing, but when the result in S216 is affirmative, the program proceeds to S218, in which the first electromagnetic valve 106*a* is made ON and the second electromagnetic valve 106*b* is made OFF to change the gear to the first speed. The predetermined fourth slip ratio $\epsilon 4$ is, for example, like the predetermined first slip ratio $\epsilon 1$, set to a threshold value that enables to determine whether the grip force is relatively large, for example to 0.3.

Thus, the processing in S104, S180 and S212 to S218 is to control the operation of the transmission 24 to select the gear based on the slip ratio $\epsilon$ (S216, S218, etc.), when the rudder angle $\alpha$ is determined to be equal to or greater than the predetermined first angle $\alpha 1$, e.g., 15 degrees (S104) and the engine speed NE is determined to be greater than the predetermined third engine speed NE3, e.g., 5000 rpm (S212), in other words relatively large turning (large turning) is detected near the maximum navigation speed of the boat.

Specifically, when large turning is detected near the maximum navigation speed of the boat and the slip ratio $\epsilon$ is equal to or greater than the predetermined fourth slip ratio $\epsilon 4$, i.e., the grip force is weak and the slipperiness is large, the control is conducted to change the gear to the first speed and lower the slip ratio, whereas when the slip ratio $\epsilon$ is smaller than the predetermined fourth slip ratio $\epsilon 4$ and the grip force is large enough (or the grip force is recovered) and the slipperiness is small enough, the control is conducted to maintain the gear to the second speed.

The turning control illustrated in the flowchart in FIG. 7 is conducted with respective outboard motors. Therefore, for example, as in this embodiment where boat 1A is equipped with two outboard motors 10A and 10B, the turning control is conducted for respective outboard motors 10A and 10B. Specifically, the slip ratio $\epsilon$ is detected for respective outboard motors 10A and 10B, and respective gears are selected based on the respective slip ratio $\epsilon$.

In FIG. 7, the program next proceeds to S220, in which the bit of the turning controlling flag is set to 1, and terminates the processing.

Returning to the explanation of the flowchart in FIG. 6, the program next proceeds to S182, in which the bit of the initial trimming flag is set to 1, and terminates the processing.

Returning to the explanation of the flowchart in FIG. 5, the program next proceeds to S12, in which a trimming up determination step whether to conduct the trimming up of the outboard motor 10 is conducted.

Figure 8:
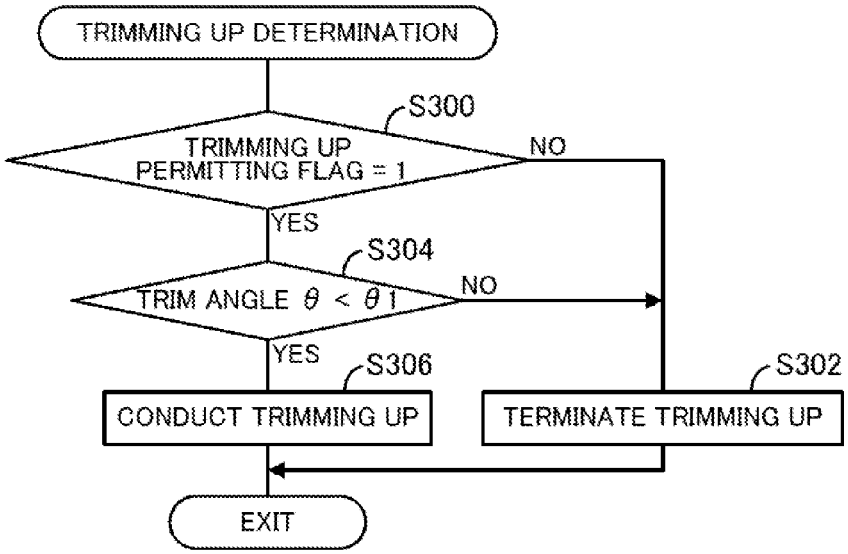
FIG. 8 is a flowchart showing the subroutine of a trimming up determination step shown in FIG. 5.

FIG. 8 is a flowchart showing the subroutine of the trimming up determination in S12 in FIG. 5. The program begins at S300, in which it is determined whether the bit of the trimming up permitting flag is 1. When the result in S300 is negative, since there is no need to conduct trimming up, the program proceeds to S302, in which the trimming up is terminated, specifically the trimming up is not conducted. On the other hand, when the result in S300 is affirmative, the program proceeds to S304, in which it is determined whether the trim angle θ is smaller than predetermined first angle θ1 (e.g., 10 degrees).

When the result in S304 is affirmative, the program proceeds to S306, in which the trim unit 26 is operated to conduct the trimming up, specifically to start the trimming up, but when the result in S304 is negative, the program proceeds to S302, in which the trimming up is terminated.

Returning to the explanation of the flowchart in FIG. 5, the program next proceeds to S14, in which the trimming down of the outboard motor 10 is conducted and the trim angle θ is initialized, specifically an initial trimming determination step whether to set the trim angle θ to an initial angle is conducted.

Figure 9:
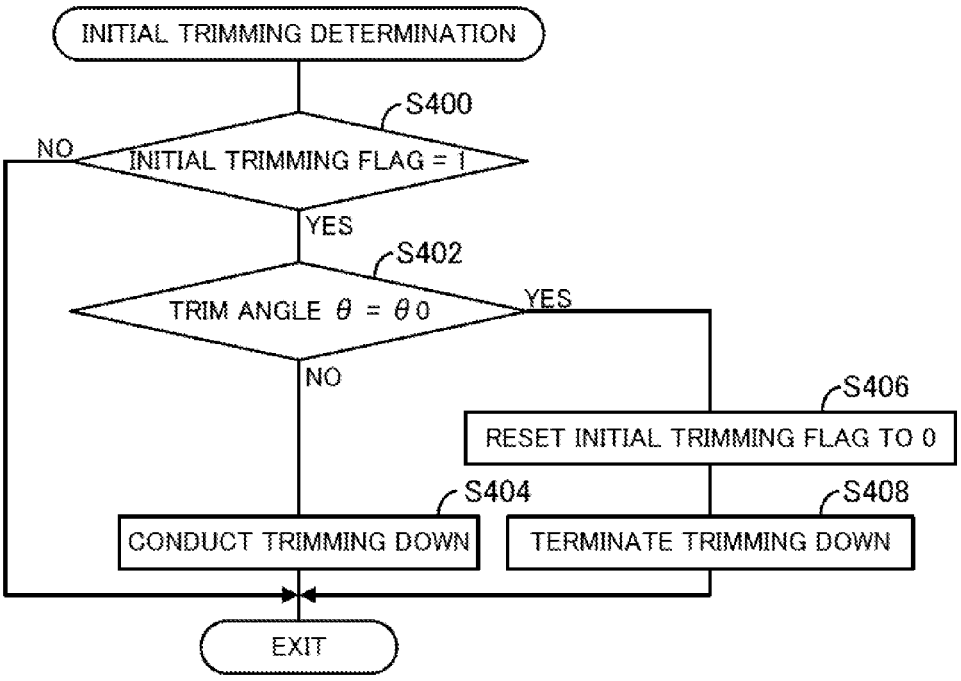
FIG. 9 is a flowchart showing the subroutine of an initial trimming determination step shown in FIG. 5.

FIG. 9 is a flowchart showing the subroutine of the initial trimming determination in S14 in FIG. 5. The program begins at S400, in which it is determined whether the bit of the initial trimming flag is 1. When the result in S400 is negative, since the trimming up is not conducted, the program skips the following processing. On the other hand, when the result in S400 is affirmative, the program proceeds to S402, in which it is determined whether the trim angle θ is the initial angle θ0 (i.e. 0 degree). When the result in S402 is negative, the program proceeds to S404, in which the trim unit 26 is operated to start the trimming down.

Then, when the trim angle θ becomes (returns to) the initial angle θ0 and the result in S402 becomes affirmative, the program proceeds to S406, in which the bit of the initial trimming flag is reset to 0, and to S408, in which the trimming down is terminated and the processing is terminated.

As mentioned above, when the turning control is conducted (S180), the bit of the initial trimming flag is set to 1 (S182), and the trim angle θ is reset to the initial angle θ0 (0 degree; S400 to S408). Specifically, when large turning is detected near the maximum navigation speed of the boat, as mentioned above, the gear is selected based on the slip ratio ϵ, and the trim angle θ is reset to the initial angle θ0 (0 degree). On the other hand, when the rudder angle α becomes smaller than the predetermined first angle α1, the processing to set the trim angle θ back to the predetermined first angle θ1, specifically the processing to trim up the trim angle θ (back) to the angle before turning is conducted (S300 to S306).

Figure 10:
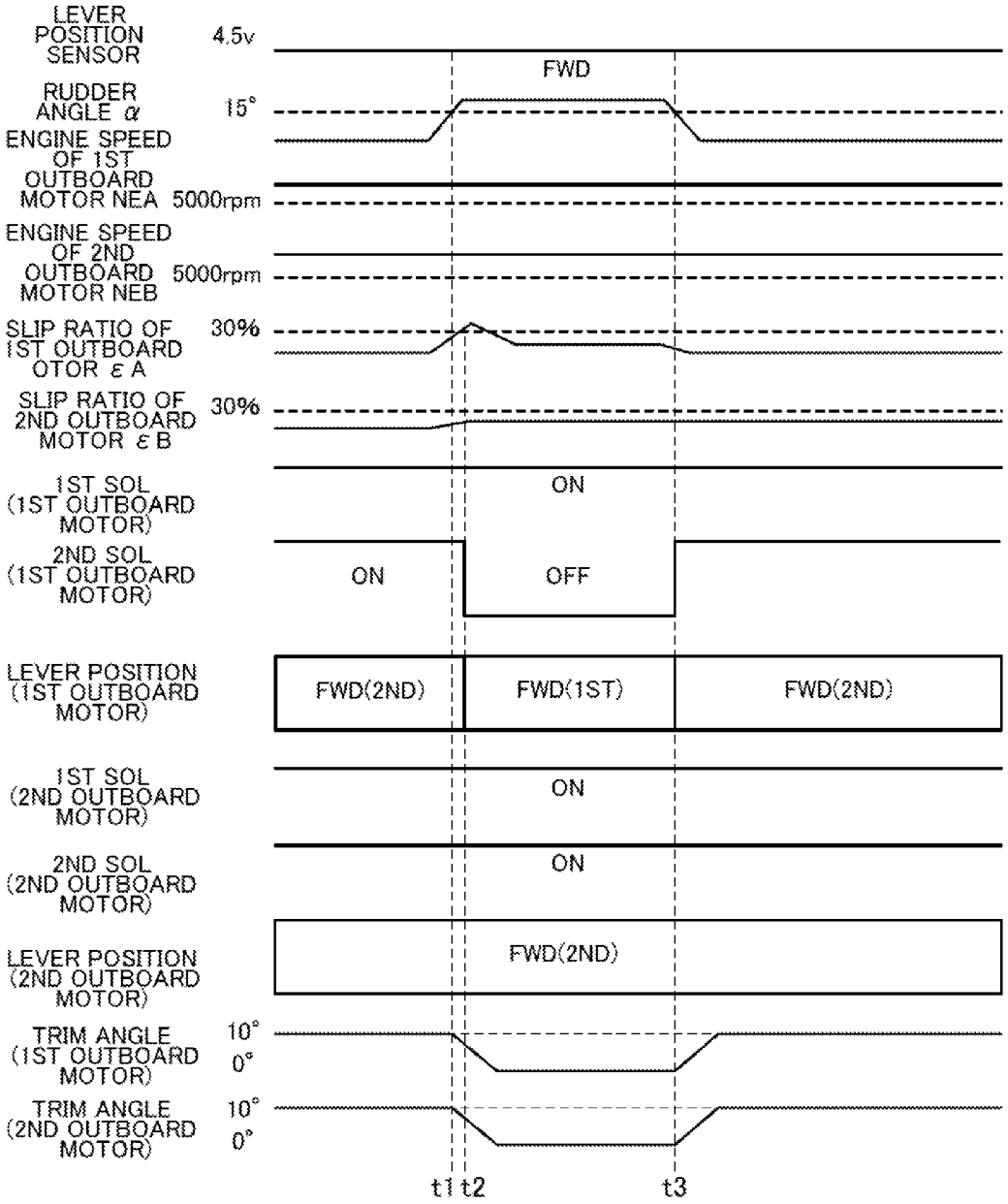
FIG. 10 is a time chart partially showing the control mentioned in the flowcharts in FIGS. 5 to 9.

FIG. 10 is a time chart partially showing the control mentioned above. As shown in this figure, at t1, since the shift/throttle lever 34 is in the forward position (the output voltage of the lever position sensor 36 is a value indicating the forward position, e.g., 4.5V (S100) and the rudder angle α detected from the rudder angle sensor 40 is equal to or greater than 15 degrees (S104) and the engine speed NE of the first, second outboard motors 10A, 10B (the engine speed of the first outboard motor 10A is shown as "NEA", the engine speed of the second outboard motor 10B is shown as "NEB") is equal to or greater than 5000 rpm (S212), the trimming down of the first, second outboard motors 10A, 10B is started (S182, S400 to S408). This trimming down is controlled to maintain the trim angle to the initial angle θ0 (0 degree; S402).

Then, at t2, since the slip ratio ϵ of the propeller 22 of the first outboard motor 10A (the slip ratio of the propeller 22 of the first outboard motor 10A is shown as "ϵA", the slip ratio of the propeller 22 of the second outboard motor 10B is shown as "ϵB") becomes equal to or greater than the predetermined fourth slip ratio (predetermined slip ratio) ϵ4 (30%), the second electromagnetic valve 106*b* (shown as "2ND SOL") of the transmission 24 of the first outboard motor 10A is made OFF (the first electromagnetic valve 106*a* (shown as "1ST SOL") is still ON) to change the gear to the first speed (S216, S218). Since the slip ratio ϵB of the propeller 22 of the second outboard motor 10B is smaller than the predetermined fourth slip ratio ϵ4, the first and second electromagnetic valves 106*a* and 106*b* of the transmission 24 of the second outboard motor 10B are made ON, specifically the gear is still the second speed.

At t3, since the rudder angle α is returned back to the predetermined first angle α1 (S104), the second electromagnetic valve 106*b* of the transmission 24 of the first outboard motor 10A is made ON to change the gear to the second speed (S160). Further, the trimming up of the first, second outboard motor 10A, 10B is started to control the trim angle θ to return to the angle before turning (predetermined first angle θ1, e.g., 10 degrees; S168, S300 to S306).

As stated above, the first embodiment is configured to have a control apparatus for at least one outboard motor (10) adapted to be mounted on a hull (12) of a boat (1A) and equipped with an internal combustion engine (50) to power a propeller (22) through a drive shaft (main shaft (60), propeller shaft (62), countershaft (68)) and a transmission (24) having selectable gears including at least a forward first speed gear (main first speed gear (76), counter first speed gear (82)) and a second speed gear (main second speed gear (74), counter second speed gear (80)) and a reverse gear (main reverse gear (78), counter reverse gear (84)), comprising: an engine speed detector (ECU (20), crank angle sensor (122), S202) adapted to detect a speed of the engine (NE (NEA, NEB)); a boat navigation speed detector (ECU(20), GPS receiver (38)) adapted to detect a navigation speed (V, Va) of the boat (1A); a rudder angle detector (ECU (20), rudder angle sensor (40), S102) adapted to detect a rudder angle (α) of the outboard motor (10) relative to the hull (12); a slip ratio detector (ECU (20), S214) adapted to detect a slip ratio (ϵ(ϵA, ϵB)) of the propeller (22) based on a theoretical navigation speed (Va) and the detected navigation speed (V) of the boat (1A); and a transmission controller (ECU (20), S104, S216, S218) adapted to control the operation of the transmission (24) to select one of the gears based on at least the detected engine speed (NE) when the detected rudder angle (α) is smaller than a predetermined angle ((α1); ECU (20), S104, S138, S160, etc.), while to select one of the gears based on the detected slip ratio (ϵ) when the detected rudder angle (α) is equal to or greater than the predetermined angle (α1); specifically, configured to select the gear based on the slip ratio (ϵ) when the boat (1A) turns equal to or greater than the predetermined first angle (α1). With this, it becomes possible to facilitate to suppress increase of the slip ratio ϵ, and to effectively suppress cavitation. For this reason, for example, even with large turning, it becomes possible to make change in direction or to turn smoothly. Further, since change in direction or turning is made smoothly, for example, there is no need to finely regulate the throttle opening or the like.

In the apparatus, the transmission controller controls the operation of the transmission (24) to select one of the gears based on the detected slip ratio (ϵ) when the detected rudder angle (α) is equal to or greater than the predetermined angle (α1) and the detected engine speed (NE) is equal to or greater than a predetermined engine speed ((NE3); ECU (20), S104, S212, S216, S218). With this, even at the time of large turning near the maximum navigation speed of the boat, it becomes possible to effectively suppress cavitation to facilitate smooth turning.

In the apparatus, the transmission controller controls the operation of the transmission (24) to select the first speed gear when the detected rudder angle (α) is equal to or greater than the predetermined angle (α1) and the detected slip ratio (ϵ) is equal to or greater than a predetermined slip ratio ((ϵ4); ECU (20), S216, S218). With this, it becomes possible to suppress cavitation more effectively to facilitate smooth turning.

In the apparatus, the transmission controller controls the operation of the transmission (24) to select the second speed gear or higher one when the detected rudder angle (α) becomes smaller than the predetermined angle (α1) after having been once equal to or greater than the predetermined angle ((α1); ECU (20), S104, S126, S160, S170). With this, it becomes possible to transit to normal navigation smoothly, after completion of turning.

The apparatus further including: a trim angle adjusting mechanism (trim unit (26)) adapted to adjust a trim angle (θ) relative to the hull (12) by trimming it up/down; and a trim angle controller (ECU (20), S104, S182, S400 to S408) adapted to control the operation of the trim angle adjusting mechanism (26) to make the trim angle (θ) to be an initial angle (0 degree) when the detected rudder angle (α) is equal to or greater than the predetermined angle (α1). With this, it becomes possible to turn more smoothly.

In the apparatus, the trim angle controller controls the operation of the trim angle adjusting mechanism (26) to make the trim angle (θ) to be a predetermined angle (θ1) when the detected rudder angle (α) becomes smaller than the predetermined angle (α1) after having been once equal to or greater than the predetermined angle ((α1); ECU (20), S104, S168, S300 to S306). With this, it becomes possible to transit to normal navigation smoothly after completion of turning.

In the apparatus, the at least one outboard motor (10) includes a first outboard motor (10A) and a second outboard motor (10B) each adapted to be mounted on the hull (12) of the boat (1A) and each equipped with the internal combustion engine (50) and the transmission (24). For this reason, it becomes possible to conduct more fine control according to situations, and to suppress cavitation more effectively to facilitate smooth turning.

Next, an outboard motor control apparatus according to a second embodiment of the invention will now be explained.

The second embodiment will be explained with focus on the points of difference from the first embodiment. With a boat installed with a plurality of outboard motors, especially three or more outboard motors, it is difficult to achieve smooth turning by only controlling transmissions of respective outboard motors equally.

Therefore, the outboard motor control apparatus according to the second embodiment of the invention is configured to suppress cavitation arising from turning effectively, and to make smooth turning even with the boat installed with three outboard motors or more.

Figure 11:
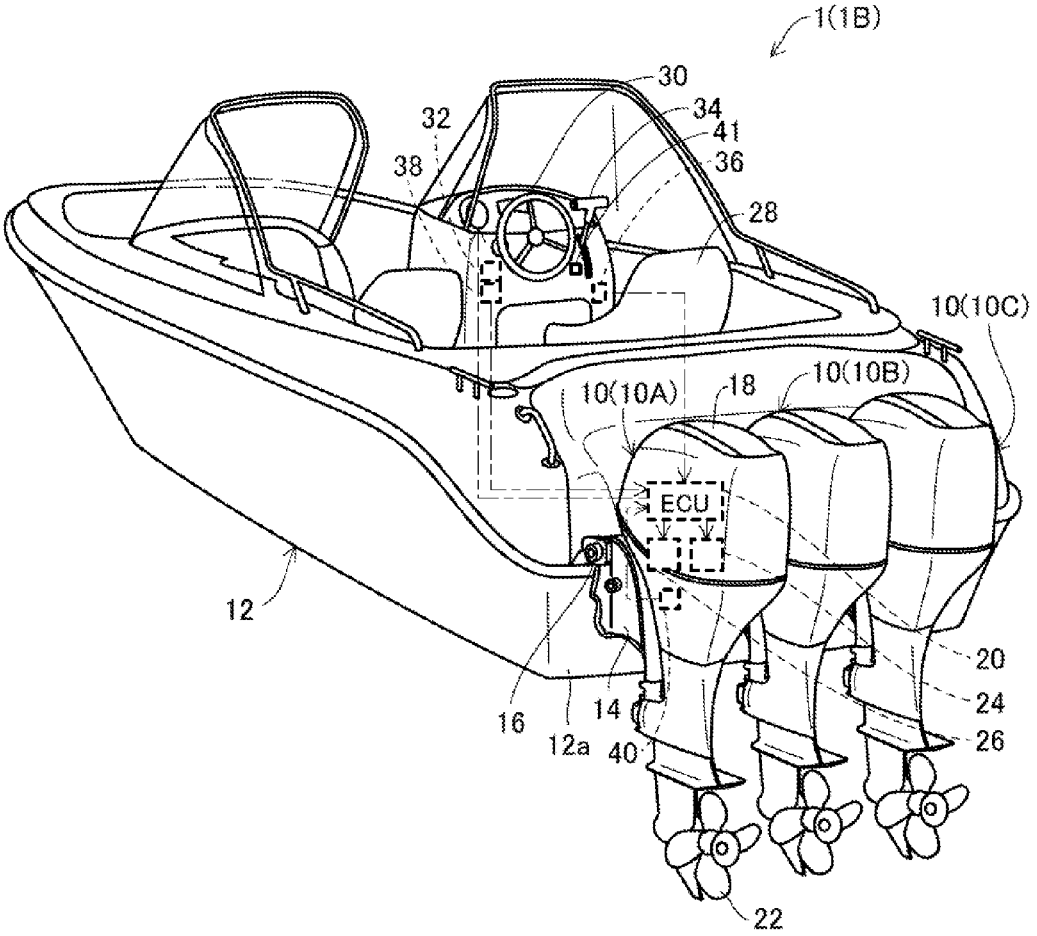
FIG. 11 is an overall schematic view of outboard motors installed on a boat to which an outboard motor control apparatus according to a second embodiment of the invention is applied.

FIG. 11 is an overall schematic view of outboard motors installed on a boat to which an outboard motor control apparatus according to a second embodiment of the invention is applied.

In FIG. 11, symbol 1B indicates the boat whose hull 12 is mounted with a plurality of outboard motors 10 side by side, specifically three outboard motors comprising a first outboard motor 10A, a second outboard motor 10B, and a third outboard motor 10C (from left-hand side as the operator faces forward toward the bow). Since the first, second and third outboard motors 10A, 10B and 10C have the same structure, they will generally be explained in the following as the outboard motors 10, unless otherwise mentioned.

Figure 12:
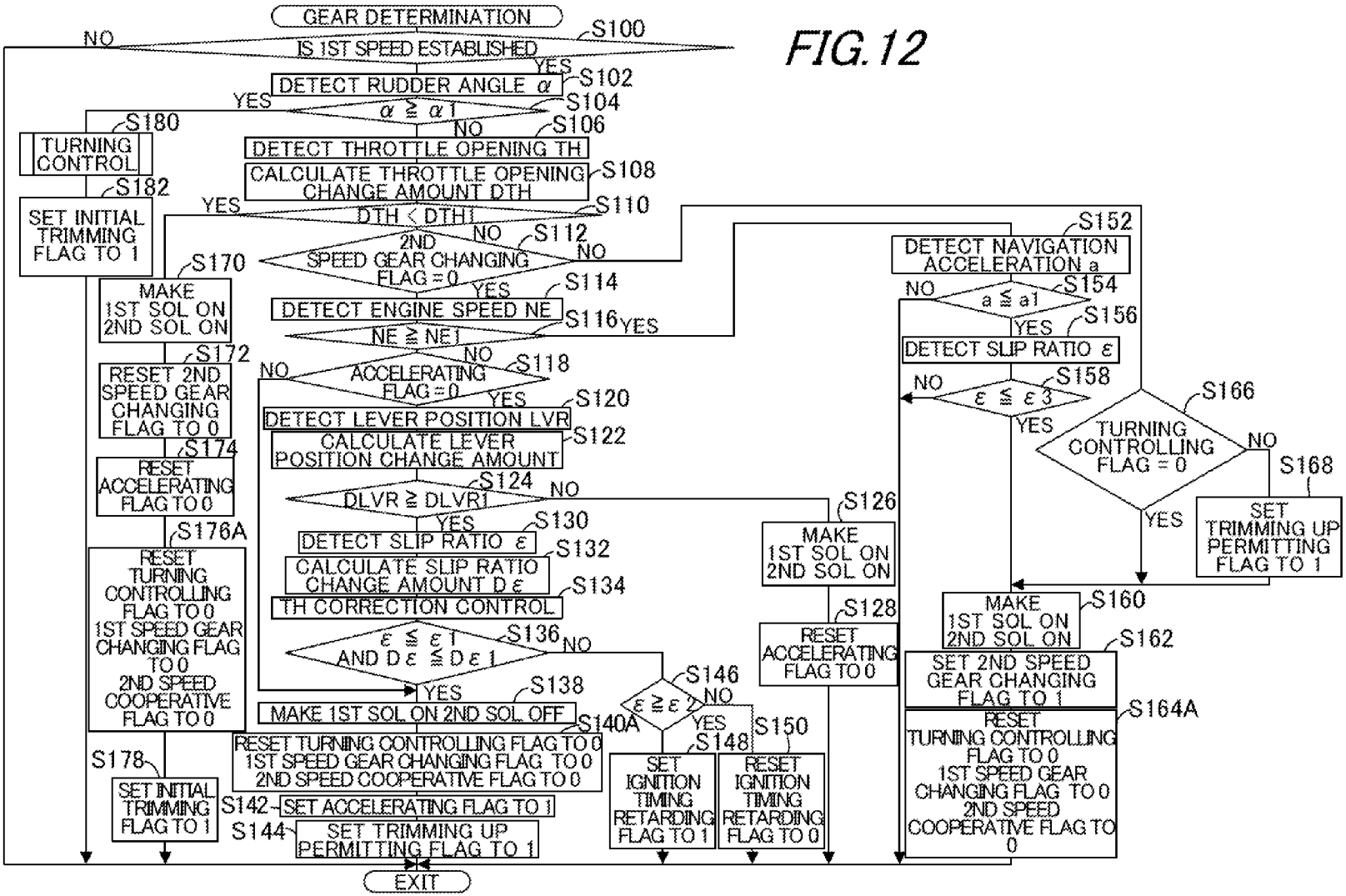
FIG. 12 is the same flowchart as FIG. 6 showing the gear determination step of the Electronic Control Unit of an outboard motor control apparatus according to the second embodiment.

FIG. 12 is the same flowchart as FIG. 6 showing the gear determination step of the ECU 20.

The flowchart in FIG. 12 differs from the flowchart in FIG. 6 only in processing in S140A, S164A and S176A, and the rest of processing is the same as the flowchart in FIG. 6. Therefore, the flowchart in FIG. 12 is explained only about processing in S140A, S164A and S176A. In S140A, S164A and S176A, the bit of a turning controlling flag, first speed gear changing flag and second speed cooperative flag are reset to 0 respectively. The first speed gear changing flag and the second speed cooperative flag are mentioned below.

In the flowchart in FIG. 12, when the result in S104 is affirmative, specifically when the detected rudder angle α is equal to or greater than the predetermined first angle α1, like the first embodiment, the program proceeds to S180, in which the turning control is conducted.

Figure 13:
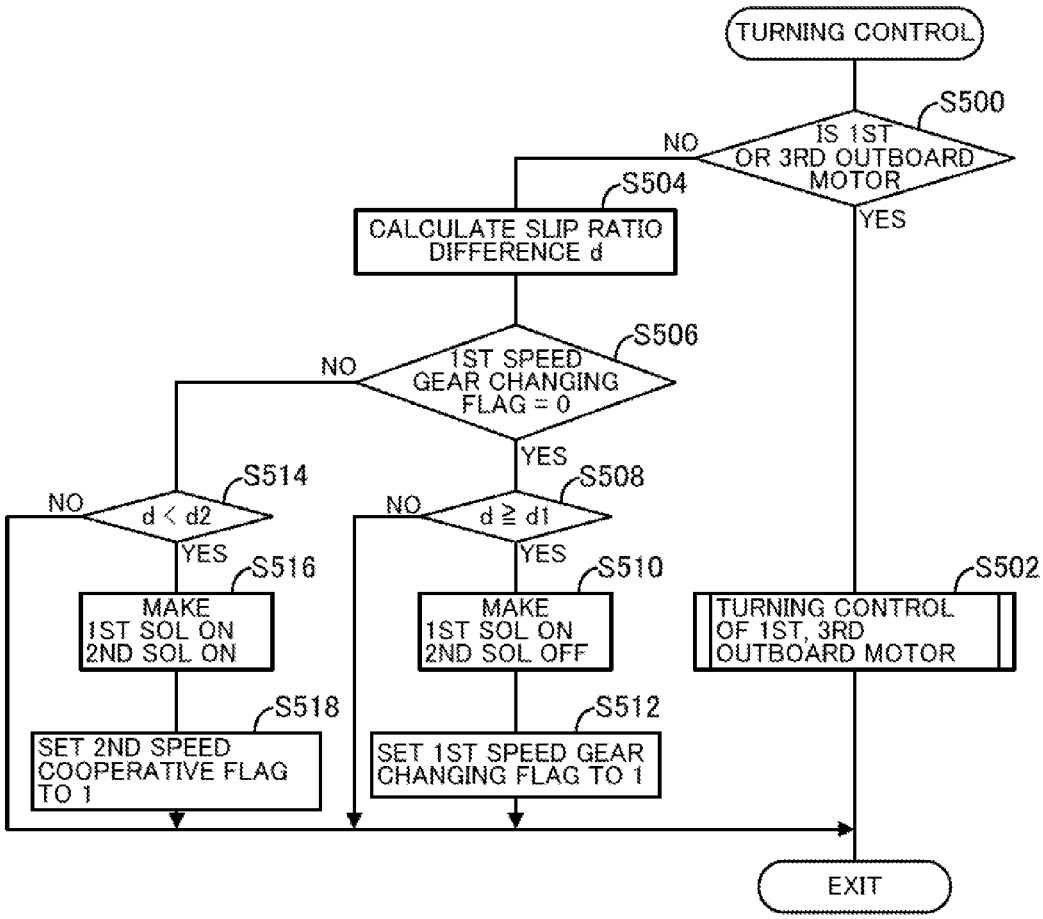
FIG. 13 is a flowchart showing the subroutine of the turning control operation shown in FIG. 12.

FIG. 13 is a flowchart showing the subroutine of the turning control operation.

The program begins at S500, in which it is determined whether the outboard motor under control in current program loop is the leftmost first outboard motor 10A or the rightmost third outboard motor 10C as the operator faces forward toward the bow. When the result in S500 is affirmative, the program proceeds to S502, in which the turning control of the first or third outboard motor 10A or 10C is conducted. On the other hand, when the result is negative and the outboard motor under control is neither the first outboard motor 10A nor the third outboard motor 10C, specifically when the outboard motor under control is the second outboard motor 10B, the program proceeds to the following processing from S504 to conduct the turning control of the second outboard motor 10B.

Figure 14:
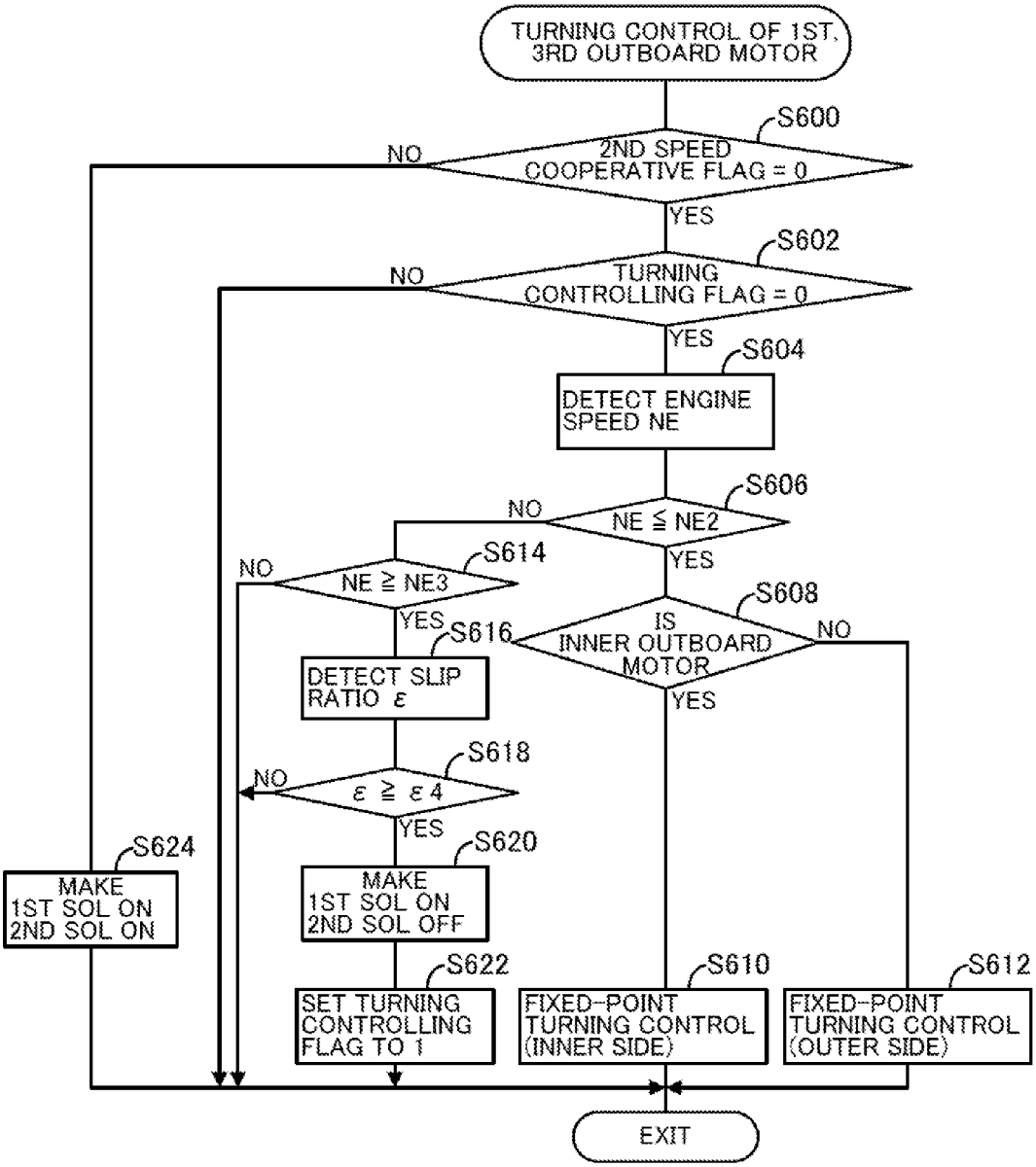
FIG. 14 is a flowchart showing the subroutine of the turning control operation of a left-hand side or right-hand side outboard motor shown in FIG. 13.

FIG. 14 is a flowchart showing the subroutine of the turning control operation of the first outboard motor 10A and the third outboard motor 10C in S502.

The program begins at S600, in which it is determined whether the bit of the second speed cooperative flag is 0. Since the initial value of the bit of the second speed cooperative flag is set to 0, the result in S600 is naturally affirmative in the first program loop and the program proceeds to S602, in which it is determined whether the bit of the turning controlling flag is 0. Since the initial value of the bit of the turning controlling flag is also set to 0, the result in S602 is naturally affirmative in the first program loop and the program proceeds to S604, in which the engine speed NE (the engine speed NEA of the first outboard motor 10A or the engine speed NEC of the third outboard motor 10C) is detected.

The program next proceeds to S606, in which it is determined whether the engine speed NE is equal to or smaller than the predetermined second engine speed NE2 (e.g., 800 rpm). When the result in S606 is affirmative, specifically when the engine speed NE is nearly equal to the idling engine speed, the program proceeds to S608, in which it is determined whether the outboard motor under control is the outboard motor situated at the inner side at turning, in other words, it is determined which one of the outboard motors is the outboard motor situated at the inner side at turning, the first outboard motor 10A or the third outboard motor 10C, from the rudder angle α. Specifically, the rudder angle α is detected, and when it is determined that the boat 1B turned counterclockwise from the detected rudder angle α, the first outboard motor 10A installed at the port side (left-hand side as the operator faces forward toward the bow) is set as the outboard motor situated at the inner side at turning, and the third outboard motor 10C installed at the starboard side (right-hand side in that direction) is set as the outboard motor situated at the outer side at turning.

On the other hand, when it is determined that the boat 1B turned clockwise from the detected rudder angle α, the third outboard motor 10C installed at the starboard side is set as the outboard motor situated at the inner side at turning, and the first outboard motor 10A installed at the port side is set as the outboard motor situated at the outer side at turning.

Since the processing in S610, S612 is the same as the processing in S208, S210 in the flowchart in FIG. 7 of the first embodiment, they will not be explained here. When the result in S606 is negative, specifically when the engine speed NE is greater than the predetermined second engine speed NE2, the program proceeds to S614 and on. Since the processing in the steps from S614 to S622 is also the same as the processing in the steps from S212 to S220 in the flowchart in FIG. 7 of the first embodiment, they will also not be explained here. However the processing in S624 will be mentioned below.

Returning to the explanation of the flowchart in FIG. 13, when the result in S500 is negative, specifically when the second outboard motor 10B is under control in current program loop, the program proceeds to S504, in which the difference d between the slip ratio ϵ(ϵA) of the propeller 22 of the first outboard motor 10A and the slip ratio ϵ(ϵC) of the propeller 22 of the third outboard motor 10C detected in S616 in FIG. 14 is calculated (hereinafter referred to as "slip ratio difference").

The slip ratio difference d̲ is calculated as an absolute value obtained by subtracting the slip ratio ϵC from the slip ratio ϵA (alternatively, the slip ratio ϵA from the slip ratio ϵC; |ϵA−ϵC|), and, for example, it becomes 10% (0.1) when the slip ratio ϵA is 10% (0.1) and the slip ratio ϵC is 20% (0.2).

The slip ratio ϵA, ϵC is calculated using the equation (1), (2) respectively. However, the slip ratio ϵA is calculated from the calculated theoretical navigation speed Va obtained from the engine speed NEA of the first outboard motor 10A and the detected navigation speed V of the boat 1B, while the slip ratio ϵC is calculated from the calculated theoretical navigation speed Va obtained from the engine speed NEC of the third outboard motor 10C and the detected navigation speed V of the boat 1B.

As mentioned above, since the slip ratio difference d̲ is calculated based on the slip ratio ϵA, ϵC detected in S616 after it was determined that the engine speed NE was equal to or greater than the predetermined third engine speed NE3 in S614 in FIG. 14, in S504 to calculate the slip ratio difference d̲, the engine speed NE is already equal to or greater than the predetermined third engine speed NE3, specifically large turning is already made near the maximum navigation speed of the boat.

The program next proceeds to S506, in which it is determined whether the bit of the first speed gear changing flag is 0. Since the initial value of the bit of the first speed gear changing flag is set to 0, the result in S506 is naturally affirmative in the first program loop and the program proceeds to S508, in which it is determined whether the calculated slip ratio difference d̲ is equal to or greater than the predetermined first slip ratio difference d1. The predetermined first slip ratio difference d1 is mentioned below.

When the result in S508 is affirmative, the program proceeds to S510, in which the first electromagnetic valve 106*a* is made ON and the second electromagnetic valve 106*b* is made OFF to change the gear of the transmission 24 to the first speed, and to S512, in which the bit of the first speed gear changing flag is set to 1. Therefore, the bit of the first speed gear changing flag is set to 1, when the calculated slip ratio difference d̲ becomes equal to or greater than the predetermined first slip ratio difference d1 and the gear of the second outboard motor 10B is changed to the first speed.

When the slip ratio difference d̲ is large, it is considered difficult to conduct the cooperative operation of the first outboard motor 10A and the third outboard motor 10C, and it becomes impossible to obtain propelling force in intended direction effectively. Therefore, it is configured to improve the propelling force (acceleration performance) by changing the gear of the second outboard motor 10B to the first speed to amplify or increase the output torque of the engine 50 of the second outboard motor 10B, when the slip ratio difference d̲ is large. Further, since the shift timing of the second outboard motor 10B is delayed when the slip ratio difference d̲ is large, for example, the acceleration performance may be degraded at the timing of re-acceleration, but this kind of problem can be solved by changing the gear of the second outboard motor 10B to the first speed. As seen from the above, the aforesaid predetermined first slip ratio difference d1 is set to a threshold value (e.g., 20% (0.2)) that enables to determine whether the cooperative operation of the first outboard motor 10A and the third outboard motor 10C is difficult or whether the acceleration performance is degraded at the timing of re-acceleration.

When the bit of the first speed gear changing flag is set to 1 in S512, the result in S506 in subsequent program loops is negative and the program proceeds to S514, in which it is determined whether the calculated slip ratio difference d̲ is smaller than the predetermined second slip ratio difference d2. Since S514 is a processing to determine whether the slip ratio difference d̲ is small enough, the predetermined second slip ratio difference d2 is set to, for example, 5%.

When the result in S514 is negative, the program terminates processing, specifically the gear is still the first speed because the slip ratio difference d̲ is still large. But when the result in S514 is affirmative, the program proceeds to S516, in which the first and second electromagnetic valves 106*a* and 106*b* are made ON to change the gear to the second speed, specifically the gear is changed to the second speed because the slip ratio difference d̲ is small enough.

The program next proceeds to S518, in which the bit of the second speed cooperative flag is set to 1. Therefore, the bit of the second speed cooperative flag is set to 1 when the slip ratio difference d̲ becomes smaller than the predetermined second slip ratio difference d2, specifically the slip ratio difference becomes smaller and the gear is changed to the second speed, after the slip ratio difference d̲ became equal to or greater than the predetermined first slip ratio difference d1 to change the gear of the second outboard motor 10B to the first speed.

When the bit of the second speed cooperative flag is set to 1, the result in S600 in the flowchart in FIG. 14 is negative and the program proceeds to S624, in which the first and second electromagnetic valves 106*a* and 106*b* of the first, third outboard motor 10A, 10C are made ON to change the gear to the second speed. Specifically, it is configured to achieve smooth turning or navigation by changing all of the gears of the outboard motors 10A, 10B and 10C to the second speed (same gear) to conduct the cooperative operation of respective outboard motors 10A, 10B and 10C when the slip ratio difference d̲ became smaller.

Figure 15:
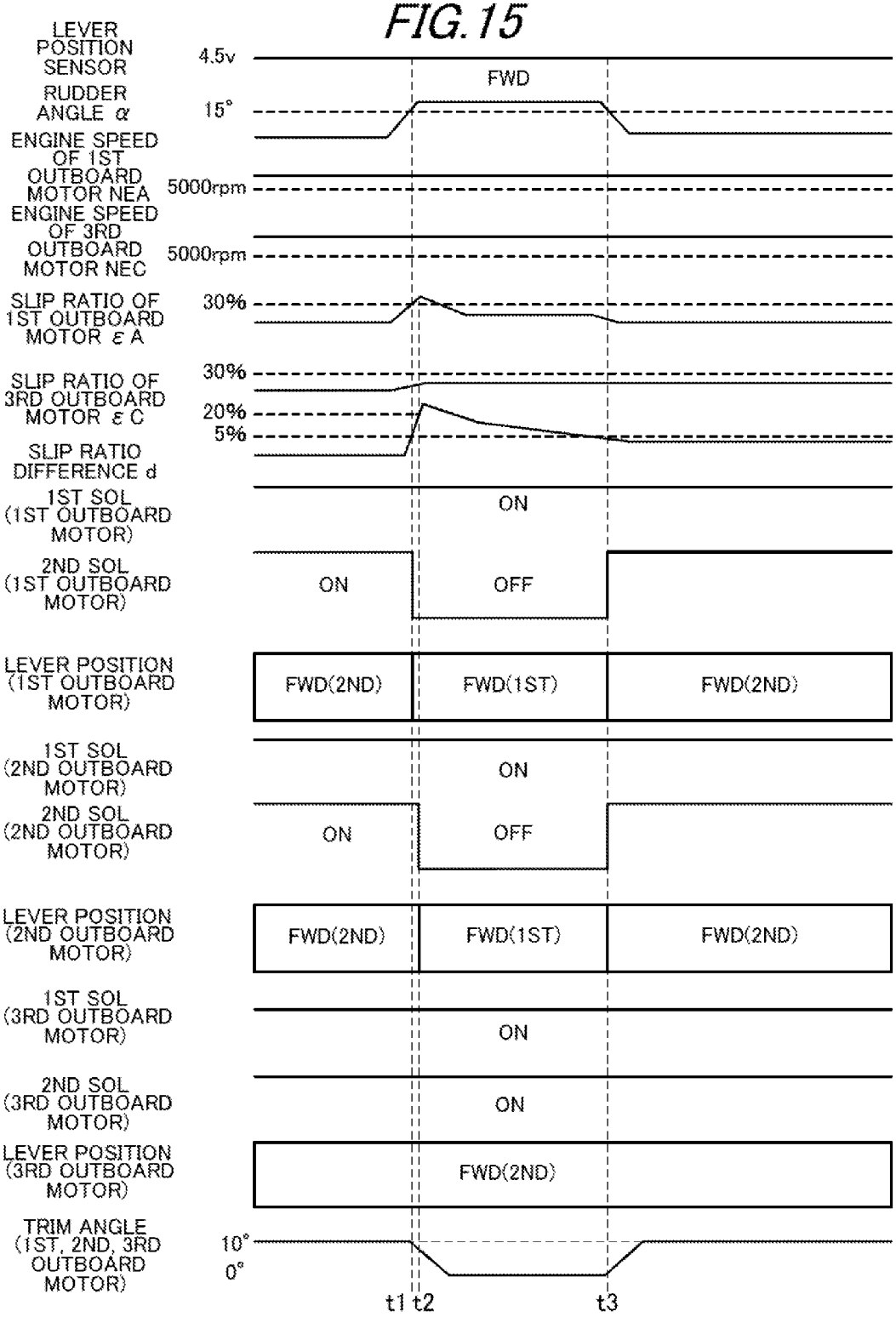
FIG. 15 is a time chart partially showing the control mentioned in the flowcharts in FIGS. 11 to 14.

FIG. 15 is a time chart partially showing the control mentioned above. As shown in this figure, at t1, since the shift/throttle lever 34 is in the forward position (the output voltage of the lever position sensor 36 is the value indicating the forward position, e.g., 4.5V; S100), the rudder angle α detected by the rudder angle sensor 40 is equal to or greater than 15 degrees (S104) and the engine speed of the first, third outboard motor 10A, 10C is equal to or greater than 5000 rpm (S614), the trimming down of the first, second, third outboard motor 10A, 10B, 10C is started (S182, S400 to S408). This trimming down is controlled to maintain the trim angle to the initial angle θ0 (0 degree; S402).

Further, since the slip ratio ϵA of the propeller 22 of the first outboard motor 10A becomes equal to or greater than the predetermined fourth slip ratio (predetermined slip ratio) ϵ4 (30%), the second electromagnetic valve 106*b* of the transmission 24 of the first outboard motor 10A is made OFF (the first electromagnetic valve 106*a* is still ON) to change the gear to the first speed (S618, S620). Further, since the slip ratio ϵC of the propeller 22 of the third outboard motor 10C is smaller than the predetermined fourth slip ratio ϵ4, the first and second electromagnetic valves 106*a* and 106*b* of the transmission 24 of the outboard motor 10C is still ON, specifically the gear is still in the second speed.

Next, at t2, since the slip ratio difference d̲ becomes equal to or greater than the first slip ratio difference d1 (20%; S508), the second electromagnetic valve 106*b* of the transmission 24 of the second outboard motor 10B is made OFF (the first electromagnetic valve 106*a* is still ON) to change the gear to the first speed (S510).

At t3, since the rudder angle α becomes smaller than the predetermined angle α1 again (S104), and the slip ratio difference d̲ also becomes smaller than the second slip ratio difference d2 (5%; S514), the second electromagnetic valve 106*b* of the transmission 24 of the second outboard motor 10B is made ON to change the gear to the second speed (S516). Further, the trimming up of the first, second, third outboard motor 10A, 10B, 10C is started to control the trim angle θ to return to the predetermined first angle before turning 01 (10 degrees; S168, S300 to S306).

As stated above, the second embodiment is configured to have a control apparatus, wherein the at least one outboard motor (10) includes a first outboard motor (10A), a second outboard motor (10B) and a third outboard motor (10C) each adapted to be mounted on the hull (12) of the boat (1B) side by side and each equipped with the internal combustion engine (50), the transmission (24), the engine speed detector (ECU (20), crank angle sensor (122), S604), the rudder angle detector (ECU (20), rudder angle sensor (40), S102), the slip ratio detector (ECU (20), S616) and the transmission controller (ECU (20), S104, S508, S510, S514, S516, etc.), wherein at least one of the slip ratio detectors of the first to third outboard motors (10) calculates a slip ratio difference (d) between the slip ratio (ϵA, ϵC) detected by the slip ratio detectors of the first and third outboard motors (10A, 10C); and the transmission controller of one of the first to third outboard motors (10) controls the operation of the transmission (24) of the second outboard motor (10B) to select one of the gears based on at least the engine speed (NEB) detected by the engine speed detector of the second outboard motor (10B) when the rudder angle (α) detected by one of the rudder angle detectors of the first to third outboard motors (10) is smaller than the predetermined angle (α1), while to select one of the gears based on the calculated slip ratio difference (d) when the rudder angle (α) detected by one of the rudder angle detectors of the first to third outboard motors (10) is equal to or greater than the predetermined angle (α1). With this, it becomes possible to effectively suppress cavitation to facilitate smooth turning even with the boat (1B) installed with three or more outboard motors. Further, when the slip ratio difference (d) is large, it is considered difficult to conduct the cooperative operation of the first outboard motor (10A) and the third outboard motor (10C), and it becomes impossible to obtain propelling force in intended direction effectively. However, when the slip ratio difference (d) is large, it becomes possible to obtain the required propelling force (acceleration performance) in intended direction by changing the gear of the second outboard motor (10B) to the first speed to amplify or increase the output torque of the engine (50) of the second outboard motor (10B). Further, since the shifting is conducted based on the slip ratio difference (d), the acceleration performance will not be degraded at the timing of re-acceleration by delaying the shift timing of the second outboard motor (10B).

In the apparatus, the transmission controller of one of the first to third outboard motors (10) controls the operation of the transmission (24) of the second outboard motor (10B) to select one of the gears based on the calculated slip ratio difference (d) when the rudder angle (α) detected by one of the rudder angle detectors of the first to third outboard motors (10) is equal to or greater than the predetermined angle (α1) and the engine speed (NE) detected by at least one of the first to third outboard motors (10) is equal to or greater than the predetermined engine speed ((NE3); ECU (20), S104, S508, S510, S514, S516). With this, it becomes possible to effectively suppress cavitation to facilitate smooth turning even when the boat (1B) installed with three or more outboard motors makes large turning near the maximum navigation speed of the boat (1B). Specifically, since it becomes difficult to turn smoothly because of large centrifugal force when making large turning near the maximum navigation speed of the boat (1B), it is general to turn with deceleration at the time of large turning, but in the invention, since the operation of the transmission (24) is controlled based on the slip ratio difference (d), it becomes possible to turn smoothly without deceleration.

In the apparatus, the transmission controller of one of the first to third outboard motors (10) controls the operation of the transmission (24) of the second outboard motor (10B) to select the first speed gear when the rudder angle (α) detected by one of the first to third outboard motors (10) is equal to or greater than the predetermined angle (α1) and the calculated slip ratio difference (d) is equal to or greater than the predetermined slip ratio difference ((d1); ECU (20), S508, S510). With this, it becomes possible to suppress cavitation more effectively to facilitate smooth turning.

In the apparatus, the transmission controller of one of the first to third outboard motors (10) controls the operation of the transmission (24) of the second outboard motor (10B) to select the second speed gear or higher one when the calculated slip ratio difference (d) becomes smaller than the predetermined slip ratio difference (d2) after having been once equal to or greater than the predetermined slip ratio difference ((d1); ECU (20), S514, S516). With this, it becomes possible to transit to normal navigation smoothly, after completion of turning.

In the apparatus, the first to third outboard motors include: a trim angle adjusting mechanism (trim unit (26)) adapted to adjust the trim angle (θ) relative to the hull (12) by trimming it up/down; and a trim angle controller adapted to control the operation of the trim angle adjusting mechanism (26) to make the trim angle (θ) to be an initial angle (θ0; 0 degree) when the detected rudder angle (α) is equal to or greater than the predetermined angle ((α1); ECU (20), S104, S182, S400 to S408). With this, it becomes possible to turn more smoothly.

Since the remaining configurations and effects are the same as the first embodiment, they will not be explained here.

Next, an outboard motor control apparatus according to the third embodiment of the invention will now be explained.

The third embodiment will be explained with focus on the points of difference from the first and second embodiments. The outboard motor control apparatus according to the third embodiment is to achieve smooth turning of the boat as the outboard motor control apparatus according to the first and second embodiments, and to improve performance as an auto spanker that keeps the navigation direction and point of the bow of the hull, by controlling the transmission.

The third embodiment is explained with the boat installed with two outboard motors as an example. Therefore, as the first embodiment, an outboard motor installed at the left-hand side as the operator faces forward toward the bow (port) is referred to as "first outboard motor" and assigned by symbol 10A, and an outboard motor installed at the right-hand side in that direction (starboard side) is referred to as "second outboard motor" and assigned by symbol 10B.

Figure 16:
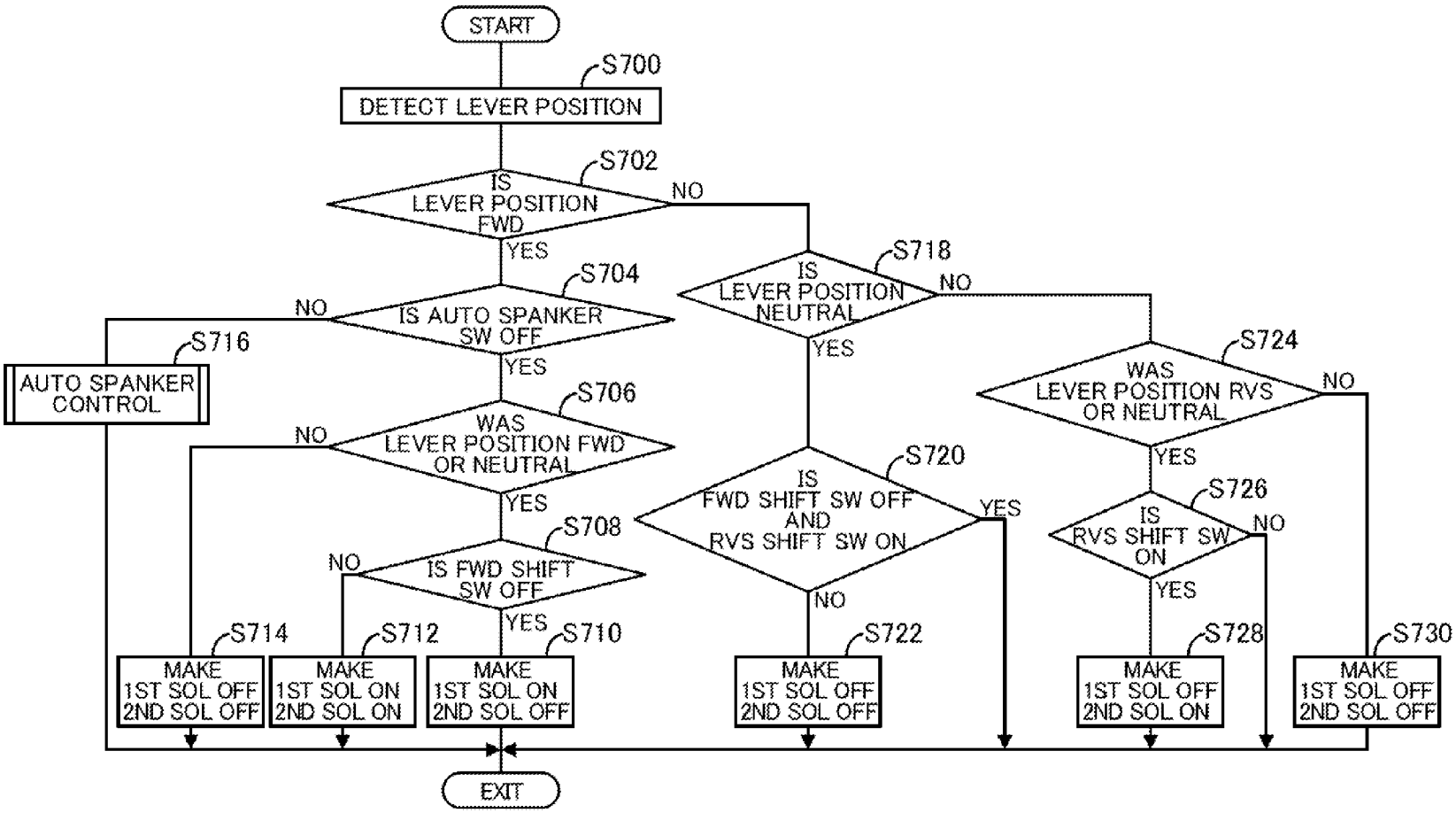
FIG. 16 is a flowchart showing a shift control operation of an outboard motor control apparatus conducted by an Electronic Control Unit of an outboard motor control apparatus according to the third embodiment of the invention.

FIG. 16 is a flowchart showing the shift control operation of the ECU 20.

As explained below, the program begins at S700, in which the lever position is detected from the output value of the lever position sensor 36. Specifically, the lever position is determined from among the forward, neutral and reverse, based on the output voltage of the lever position sensor 36.

The program next proceeds to S702, in which it is determined whether the lever position is the forward (shown as "FWD"). When the result in S702 is affirmative, the program proceeds to S704, in which it is determined whether the auto spanker switch 41 (shown as "AUTO SPANKER SW") is OFF, specifically it is determined whether a signal indicative of a instruction to conduct the auto spanker control is outputted from the auto spanker switch 41.

The result in S704 is naturally affirmative in the first program loop and the program proceeds to S706, in which it is determined whether the lever position in the preceding program loop was the forward or neutral.

When the result in S706 is affirmative, specifically when the preceding lever position was the forward or the neutral and the current lever position is the forward, in other words when the lever position is still the forward or changed from the neutral to the forward, the program proceeds to S708, in which it is determined whether the forward shift switch (shown as "FWD SHIFT SW") is OFF, i.e., it is determined whether the first speed gear clutch C1 is not connected to the main first speed gear 76.

When the result in S708 is affirmative, the program proceeds to S710, in which the first electromagnetic valve 106*a* is made ON and the second electromagnetic valve 106*b* is made OFF to change the gear of the transmission 24 to the first speed.

Since the gear of the transmission 24 is changed to the first speed, the first speed gear clutch C1 is connected to the main first speed gear 76 and the forward shift switch is made ON in S710, the result in S708 in the subsequent program loop is negative and the program proceeds to S712, in which the first and second electromagnetic valves 106*a* and 106*b* are made ON to change the gear of the transmission 24 to the second speed.

When the result in S706 is negative, specifically when the preceding lever position is the reverse and the current lever position is the forward, in other words when the lever position is changed from the reverse to the forward, the program proceeds to S714, in which the first and second electromagnetic valves 106*a* and 106*b* are made OFF to select the neutral.

When the result in S704 is negative, specifically when auto spanker switch 41 is ON, the program proceeds to S716, in which the auto spanker control is conducted.

Figure 17:
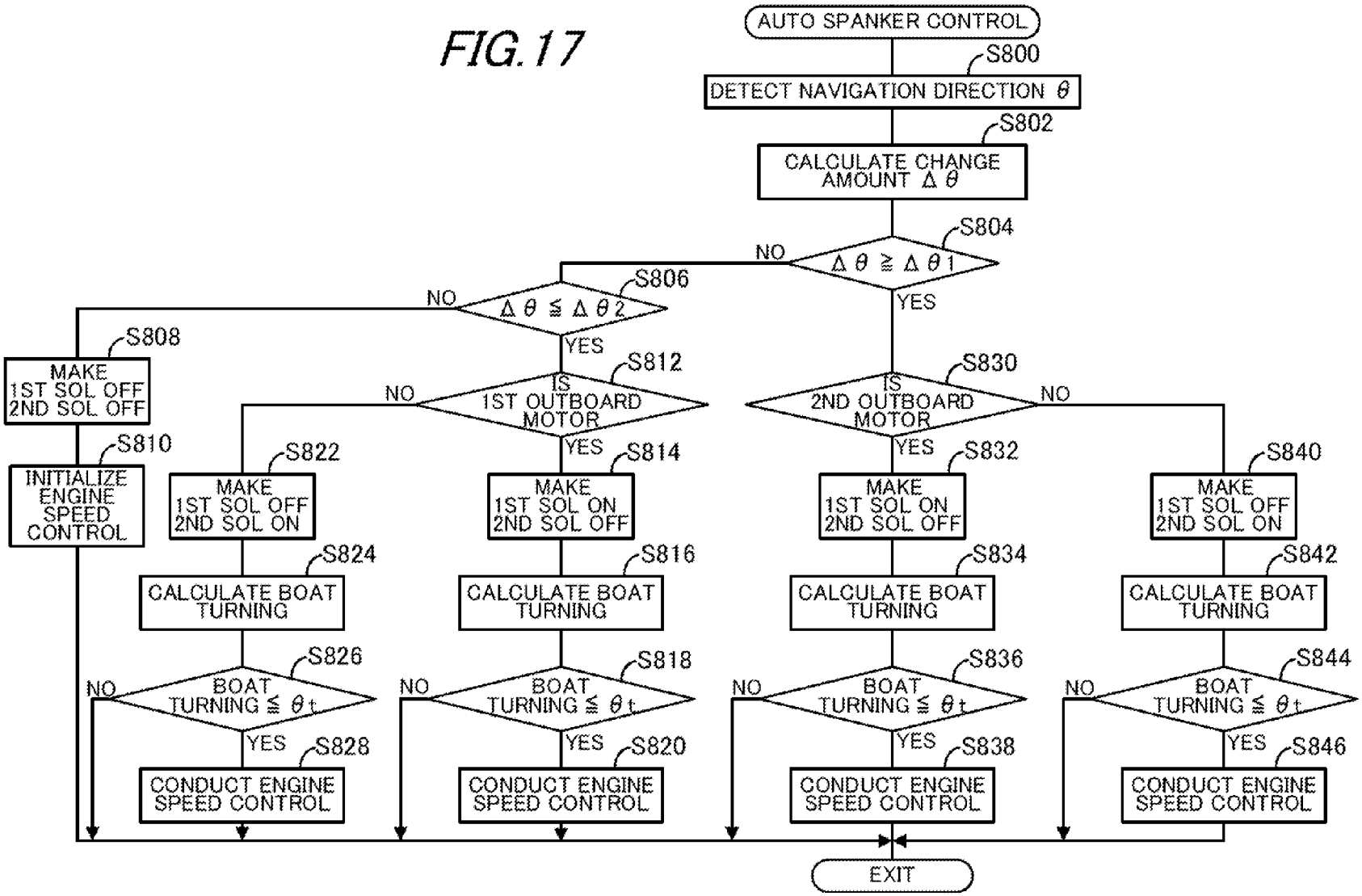
FIG. 17 is a flowchart showing the subroutine of an auto spanker control operation shown in FIG. 16.

FIG. 17 is a flowchart showing the subroutine of the auto spanker control operation.

The program begins at S800, in which the current navigation direction (angle) θ of the boat 1A is detected (obtained). In the first program loop directly after making the auto spanker switch 41 ON, the detected direction θ is set to (stored (learned) as) a reference direction for calculating an amount of change in the direction θ mentioned below (change angle or turning angle) per unit time Δθ.

The program next proceeds to S802, in which the amount of change Δθ in the detected direction θ per unit time, specifically the amount of change in the detected direction (rotation) θ relative to the reference direction is calculated as the amount of change Δθ. However, as mentioned above, the amount of change Δθ calculated in the first program loop (S802) is 0 in the first program loop, since turning θ detected in S800 is set as the reference direction.

The program next proceeds to S804, in which it is determined whether the calculated amount of change Δθ is equal to or greater than a predetermined first value Δθ1. In this embodiment, the predetermined first value Δθ1 is set to a value indicative of the amount of change in clockwise direction, specifically a threshold value (angle) that enables to determine whether the direction θ is not kept constant, for example to +5 degrees.

As mentioned above, in the first program loop, the amount of change Δθ is 0, the result in S804 is negative and the program proceeds to S806, in which it is determined whether the calculated amount of change Δθ is equal to or smaller than a predetermined second value Δθ2. Contrary to the predetermined first value Δθ1, the predetermined second value Δθ2 is a value indicative of the amount of change in counterclockwise direction, for example, it is set to −5 degrees.

The result in S806 in the first program loop is negative and the program proceeds to S808, in which the first and second electromagnetic valves 106*a* and 106*b* are made OFF to select the neutral.

The program next proceeds to S810, in which an engine speed control to increase/decrease the engine speed NE (mentioned below) is initialized, specifically terminated (when the engine speed control is active, it is terminated, and when inactive, it is kept inactive).

Further, when the result in S806 is affirmative, specifically the amount of change Δθ is equal to or smaller than the predetermined second value Δθ2 (−5 degrees), in other words when the direction θ is changed relative to the reference direction in counterclockwise direction by the predetermined angle (5 degrees) or more, the program proceeds to S812, in which it is determined whether the first outboard motor 10A is the outboard motor 10 under control in the current program loop. In this step, since the amount of change Δθ is equal to or smaller than the predetermined second value Δθ2, specifically −5 degrees or smaller, the boat 1A is considered to be turned (rotated) in counterclockwise direction. Therefore, the first outboard motor 10A corresponds to the outboard motor 10 situated at the inner side at turning.

When the result in S812 is affirmative, specifically when the outboard motor 10 under control is the first outboard motor 10A, in other words the outboard motor 10 situated at the inner side at turning, the program proceeds to S814, in which the first electromagnetic valve 106*a* of the first outboard motor 10A is made ON and the second electromagnetic valve 106*b* is made OFF to change the gear of the transmission 24 to the first speed.

The program next proceeds to S816, in which additional turning (rotation) of the boat 1A around the time of changing the gear to the first speed (hereinafter referred to as "boat turning") is detected. Specifically, the direction θ is detected again after changing the gear to the first speed, and the amount of change in the direction θ, i.e., boat turning around the time of detection of the shift change, is detected.

The program next proceeds to S818, in which it is determined whether the detected boat turning is equal to or smaller than a predetermined angle of turning θt, e.g., 2 degrees (hereinafter the same). When the result in S818 is negative, the program terminates processing, but when the result in S818 is affirmative, the program proceeds to S820, in which the engine speed control is conducted.

The engine speed control is a control to increase the engine speed NE to bring the direction θ of the boat 1A back to the reference direction. Specifically, when the amount of change of the direction θ of the boat 1A to return to the reference direction is not enough even though the gear is changed to the first speed, the engine speed NE is regulated by the engine speed control, i.e., the direction of the boat 1A is brought back to the reference direction by increasing the engine speed NE. Therefore, the engine speed control is not conducted when the boat turning is greater than the predetermined angle of turning θt, since it is determined that the boat 1A is turned enough to return to near the reference direction. On the other hand, the engine speed control is conducted to facilitate turning (rotation) of the boat 1A when the boat turning is equal to or smaller than the predetermined angle of turning θt, since it is determined that the boat 1A is not moved as expected (not brought back to near the reference direction) even though the gear is changed to the first speed.

Further, when the result in S812 is negative, specifically when the outboard motor 10 under control is the second outboard motor 10B, i.e., when the outboard motor 10 situated at the outer side at turning, the program proceeds to S822, in which the first electromagnetic valve 106*a* of the second outboard motor 10B is made OFF and the second electromagnetic valve 106*b* is made ON to change the transmission 24 to the reverse.

The program next proceeds to S824, in which the boat turning around the time of changing the gear to the reverse is detected, and to S826, in which it is determined whether the detected boat turning is equal to or smaller than the predetermined angle of turning θt. When the result in S826 is negative, the program terminates processing, but when the result in S826 is affirmative, the program proceeds to S828, in which the aforesaid engine speed control is conducted.

Further, when the result in S804 is affirmative, specifically the calculated amount of change Δθ is equal to or greater than predetermined first value Δθ1 (+5 degrees), in other words when the direction θ is rotated by a predetermined angle (5 degrees) or more in clockwise direction relative to the reference direction, the program proceeds to S830, in which it is determined whether the outboard motor 10 under control is the second outboard motor 10B. In this step, since the amount of change Δθ is equal to or greater than the predetermined first value Δθ1, i.e., +5 degrees or more, the boat is considered to be turned (rotated) in clockwise direction. Therefore, the second outboard motor 10B corresponds to the outboard motor 10 situated at the inner side at turning.

When the result in S830 is affirmative, specifically when the outboard motor 10 under control is the second outboard motor 10B, in other words the outboard motor 10 situated at the inner side at turning, the program proceeds to S832, in which the first electromagnetic valve 106*a* of the second outboard motor 10B is made ON and the second electromagnetic valve 106*b* is made OFF to change the gear of the transmission 24 to the first speed.

The program next proceeds to S834, in which the boat turning around the time of changing the gear to the first speed is detected, and to S836, in which it is determined whether the detected boat turning is equal to or smaller than the predetermined angle of turning θt. When the result in S836 is negative, the program terminates processing, but when the result in S836 is affirmative, the program proceeds to S838, in which the engine speed control is conducted.

Further, when the result in S830 is negative, specifically when the outboard motor 10 under control is the first outboard motor 10A, in other words the outboard motor 10 situated at the outer side at turning, the program proceeds to S840, in which the first electromagnetic valve 106*a* of the first outboard motor 10A is made OFF and the second electromagnetic valve 106*b* is made ON to shift the transmission 24 to the reverse.

The program next proceeds to S842, in which the boat turning around the time of changing the gear to the reverse is detected, and to S844, in which it is determined whether the detected boat turning is equal to or smaller than the predetermined angle of turning θt. When the result in S844 is negative, the program terminates processing, but when the result in S844 is affirmative, the program proceeds to S846, in which the engine speed control is conducted.

As mentioned above, when the auto spanker switch 41 is made ON (S704), the auto spanker control first set the reference direction of the boat 1A (S800), and then shift the transmission 24 to the neutral (S808). After that, the amount of change in the detected direction (turning) θ of the boat 1A relative to the reference direction is calculated as the amount of change Δθ (S802), and when the amount of change Δθ is changed by the predetermined value (predetermined first value Δθ1 or predetermined second value Δθ2) or more in clockwise or counterclockwise direction (S804, S806), the transmission 24 of the outboard motor 10 situated at the inner side at turning is changed to the first speed (S814, S832) and the transmission 24 of the outboard motor 10 situated at the outer side at turning is changed to the reverse (S822, S840). It becomes possible to bring the direction θ of the boat 1A back to the reference direction by controlling in this way.

Further, when returning movement of the boat 1A is still not enough even though the transmission 24 is controlled as above, it is also possible to bring the boat 1A to the reference direction promptly and reliably by additionally conducting the engine speed control (S818, S820, etc.).

Returning to the explanation of FIG. 16, when the result in S702 is negative, specifically when the lever position is not the forward, the program proceeds to S718, in which it is determined whether the lever position is the neutral. When the result in S718 is affirmative, the program proceeds to S720, in which it is determined whether the forward shift switch is OFF and the reverse shift switch (shown as "RVS SHIFT SW") is ON, in other words it is determined whether the first speed gear clutch C1 is not connected to the main first speed gear 76 and the reverse gear clutch CR is not connected to the counter reverse gear 84, specifically the first speed gear clutch C1 and the reverse gear clutch CR are in the neutral position.

When the result in S720 is affirmative, the program terminates processing, but when the result in S720 is negative, the program proceeds to S722, in which the first and second electromagnetic valve 106*a* and 106*b* are made OFF to select the neutral.

Further, when the result in S718 is negative, specifically when the lever position is the reverse, the program proceeds to S724, in which it is determined whether the preceding lever position was the reverse (shown as "RVS") or the neutral. When the result in S724 is affirmative, the program proceeds to S726, in which it is determined whether the reverse shift switch is ON.

When the result in S726 is negative, the program terminates processing, but when the result in S726 is affirmative, the program proceeds to S728, in which the first electromagnetic valve 106*a* is made OFF and the second electromagnetic valve 106*b* is made ON to select the reverse.

Further, when the result in S724 is negative, specifically when the preceding lever position was the forward and the current lever position is the reverse, in other words when the lever position is changed from the forward to the reverse, the program proceeds to S730, in which the first and second electromagnetic valve 106*a* and 106*b* are made OFF to select the neutral.

Figure 18:
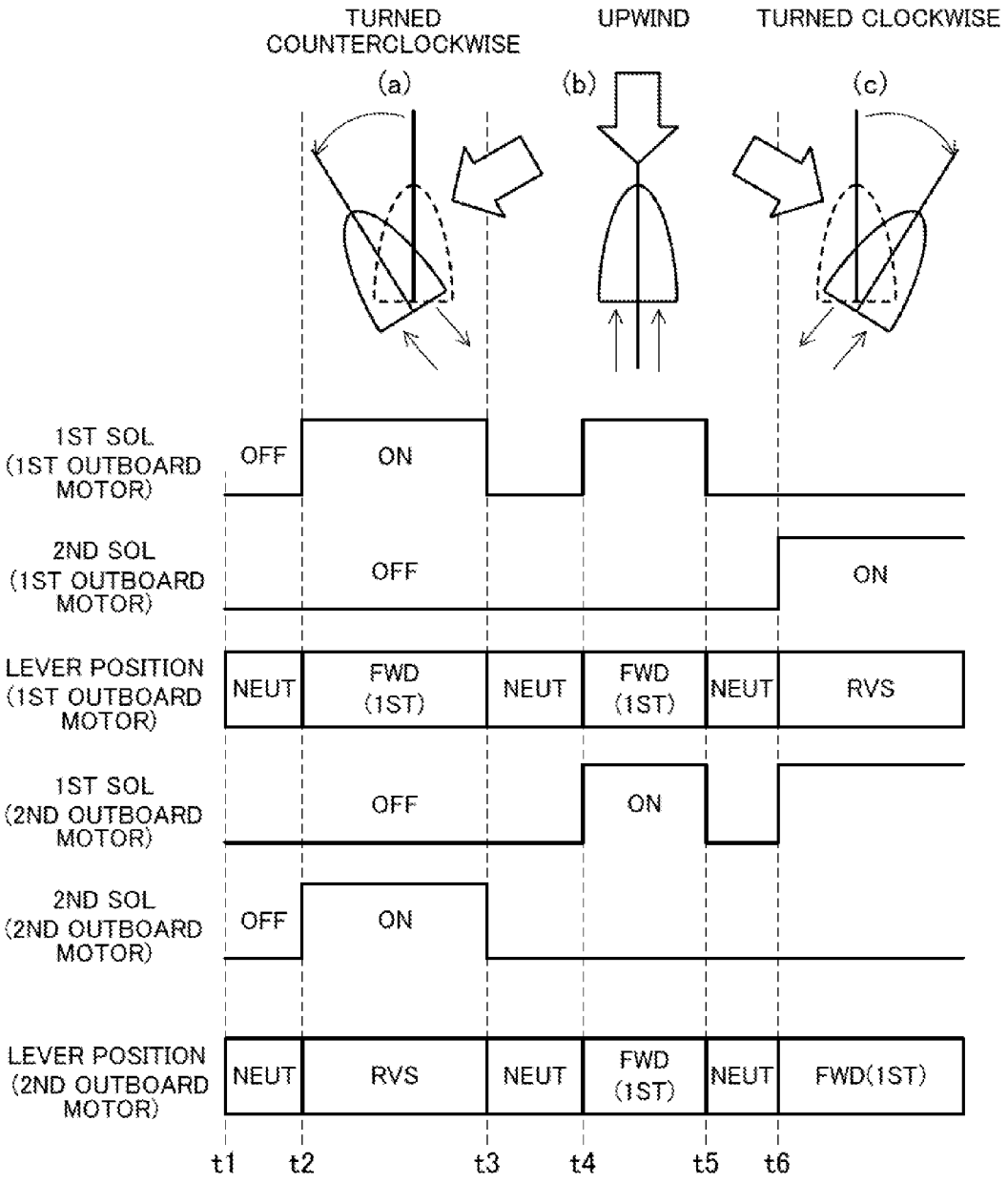
FIG. 18 is a time chart partially showing the control mentioned in the flowcharts in FIGS. 16 and 17.

FIG. 18 is a time chart partially showing the control mentioned above. First, if the auto spanker switch 41 is made ON at t1 (S704), the current direction θ of the boat 1A is detected, the detected direction θ is set as the reference direction (S800), and all of the first and second electromagnetic valves 106*a* and 106*b* of the outboard motor 10A, 10B are made OFF to shift the transmission 24 to the neutral (S808).

Next, when the amount of change Δθ is equal to or smaller than the predetermined second value Δθ2, specifically when the direction θ of the boat 1A is changed by the predetermined angle or more in counterclockwise direction ((a) in FIG. 18, S806), at t2, the first electromagnetic valve 106*a* of the first outboard motor 10A corresponding to the outboard motor 10 situated at the inner side at turning is made ON and the second electromagnetic valve 106*b* is made OFF to change the gear of the transmission 24 to the first speed (S814), and the first electromagnetic valve 106*a* of the second outboard motor 10B corresponding to the outboard motor 10 situated at the outer side at turning is made OFF and the second electromagnetic valve 106*b* is made ON to shift the transmission 24 to the reverse (S822).

At t3, since the amount of change Δθ exceeded the predetermined second value Δθ2 and the direction returned to near the reference direction (S806), the first and second electromagnetic valve 106*a* and 106*b* are made OFF to shift the transmission 24 of all of the outboard motors 10A, 10B to the neutral (S808).

Now, as mentioned above, it becomes possible to bring the direction θ back to the reference direction by controlling the transmission 24 of respective outboard motors 10A and 10B based on the amount of change Δθ or the turning direction, but, for example, there is a case that the direction θ is in the reference direction but the boat 1A is drifted backward from the upwind effect ((b) in FIG. 18). Therefore, in this case, as shown at t4, the first electromagnetic valves 106*a* of all of the outboard motors, specifically the first, second outboard motors 10A, 10B are made ON and the second electromagnetic valves 106*b* are made OFF to change the gear of the transmission 24 to the first speed, and to exert the propelling force on the boat 1A in forward direction. With this, it becomes possible to keep the boat 1A in the predetermined position even with strong upwind.

Therefore, for example, on the other hand, when the boat 1A will be drifted forward from the downwind effect with the gear remain in the neutral even though the direction θ of the boat 1A is in the reference direction, it becomes possible to keep the boat 1A in the predetermined position as above by making the first electromagnetic valves 106*a* of all of the outboard motors 10A, 10B OFF and the second electromagnetic valves 106*b* ON to shift the transmission 24 to the reverse and to exert the propelling force on the boat 1A in backward direction.

Specifically, though not explained in flowchart in FIG. 17, even when the boat 1A is brought back to near the reference direction under the auto spanker control, but is disadvantageously drifted backward/forward from the downwind/upwind effect and the like, the embodiment makes it possible to keep the boat 1A not only in navigation direction θ but also in backward/forward moving direction by shifting the transmissions 24 of all of the outboard motors 10A, 10B to the reverse/first speed to exert the propelling force in backward/forward direction to the boat 1A.

Next, at t5, since there is no need to keep the gear to the first speed because of weakened wind and the like (the direction θ of the boat 1A is still near the reference direction), the first and second electromagnetic valves 106*a* and 106*b* are made OFF to shift the transmission 24 to the neutral again.

After that, now, since the amount of change Δθ becomes equal to or greater than the predetermined first value Δθ1 and the direction θ of the boat 1A is changed in clockwise direction relative to the reference direction ((c) in FIG. 18, S804), at t6, the first electromagnetic valve 106*a* of the second outboard motor 10B corresponding to the outboard motor 10 situated at the inner side at turning is made ON and the second electromagnetic valve 106*b* is made OFF to change the gear of the transmission 24 to the first speed (S832), while the first electromagnetic valve 106*a* of the first outboard motor 10A corresponding to the outboard motor 10 situated at the outer side at turning of the boat is made OFF and the second electromagnetic valve 106*b* is made ON to change the gear of the transmission 24 to the reverse (S840).

As stated above, the third embodiment is configured to have a control apparatus, wherein the first and second outboard motors (10) include: a navigation direction detector (ECU (20), GPS receiver (38), S800) adapted to detect navigation direction (θ) of the boat (1A); a direction change amount calculator (ECU (20), S802) adapted to calculate an amount of change of the direction (Δθ) per unit time; and a second transmission controller (ECU (20), S804, S806, S808, S814, S822, S832, S840) adapted to control the operation of the transmission (24) of the first and second outboard motors (10) to select one of the gears based on the calculated amount of change of the direction (Δθ). Specifically, the third embodiment is configured to control the transmission (24) of the outboard motor (10) by detecting the actual movement of the boat (1A). With this, even though there is not only wind effect but also tidal effect to the boat (1A), since the effect can be detected as the amount of change (Δθ) in the direction (θ), it becomes possible to keep the bow direction (θ) and the position constant by controlling the operation of the transmission (24) based on the detected amount of change (Δθ).

In the apparatus, the first and second outboard motors (10) include: a direction storing instructor (ECU (20), auto spanker switch (41), S704) installed manipulatably by an operator and adapted to instruct to store the detected direction (θ) upon manipulation by the operator; and a direction storer (ECU (20), S800) that stores the detected direction (θ) based on the instruction of the direction storing instructor, wherein the direction change amount calculator calculates the amount of change of the direction (Δθ) per unit time based on the stored direction ((θ); ECU (20), S802). With this, it becomes possible to keep the bow direction and the position constant by the manipulation of the operator.

In the apparatus, the second transmission controller of the first or second outboard motor (10) controls the operation of the transmission (24) to select the first speed gear for the outboard motor (10) situated at an inner side at turning of the boat (1A) when the calculated amount of change (Δθ) is equal to or greater than the predetermined value ((Δθ1, Δθ2); this means that the absolute value of the amount of change (Δθ) is equal to or greater than the absolute value of predetermined second value (Δθ2), since the predetermined second value (Δθ2) is negative value; hereinafter the same; ECU (20), S814, S832). With this, it becomes possible to keep the bow direction and the position more constantly.

In the apparatus, the second transmission controller of the first or second outboard motor (10) controls the operation of the transmission (24) to select the reverse gear for the outboard motor (10) situated at an outer side at turning of the boat (1A) when the calculated amount of change (Δθ) is equal to or greater than the predetermined value ((Δθ1, Δθ2); ECU (20), S822, S840). With this, it becomes possible to keep the bow direction and the position more constantly.

In the apparatus, the second transmission controller of the first or second outboard motor (10) controls the operation of the transmission (24) to select a same gear for all of the first and second outboard motors (10) when the calculated amount of change ($\Delta\theta$) is smaller than the predetermined value ($\Delta\theta1$, $\Delta\theta2$). With this, it becomes possible to bring the position of the boat (1A) back to the predetermined position, even though the boat (1A) moves in not only the direction ($\theta$) but also in foreword/backward direction.

Since the remaining configurations and effects are the same as the first, second embodiment, they will not be explained here.

It should be noted that, although the invention has been mentioned for the outboard motor exemplified above, the invention can be applied to an inboard motor equipped with the same transmission.

It should further be noted that, although the engine speed is determined in the processing in the flowcharts in FIGS. 6, 7, 12 and 14 for the outboard motor 10A, 10B or 10C concerned, an average value of the outboard motors 10A, 10B and 10C can instead be used.

It should further be noted that, although the boat 1A installed with two outboard motors 10A, 10B is described as an example in the first embodiment, the boat can be installed with one outboard motor, moreover, three or more outboard motors.

It should further be noted that, although the boat 1B installed with three outboard motors 10A, 10B and 10C is described as an example in the second embodiment, the boat can be installed with four or more outboard motors. Furthermore, although the boat 1A installed with two outboard motors 10A, 10B is described as an example in the third embodiment, the boat can be installed with three or more outboard motors.

It should further be noted that, although the predetermined first angle $\alpha1$, predetermined first value DTH1, predetermined first value DLVR1, predetermined first engine speed NE1, predetermined second engine speed NE2, predetermined third engine speed NE3, predetermined first slip ratio $\epsilon1$, predetermined second slip ratio $\epsilon2$, predetermined third slip ratio $\epsilon3$, predetermined fourth slip ratio $\epsilon4$, predetermined first amount of change in the slip ratio $D\epsilon1$, initial angle $\theta0$, predetermined first slip ratio difference d1, predetermined second slip ratio difference d2, predetermined first angle $\theta1$, predetermined first value $\Delta\theta1$, predetermined second value $\Delta\theta2$, predetermined angle of turning $\theta t$, displacement of the engine etc. are mentioned in the above as the specific values, they are examples and should not be limited thereto.

Japanese Patent Application Nos. 2013-18812, 2013-18813 and 2013-18814 filed on Feb. 1, 2013, are incorporated by reference herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. A control apparatus for an outboard motor system, comprising a boat navigation speed detector adapted to detect a navigation speed of a boat, the outboard motor system including a first outboard motor, a second outboard motor and a third outboard motor adapted to be mounted on a hull of a boat side by side, each of the first, second and third outboard motors comprising:

an internal combustion engine provided to power a propeller through a drive shaft;

a transmission including selectable forward first and second speed gears and a reverse gear;

an engine speed detector adapted to detect a speed of the engine;

a rudder angle detector adapted to detect a rudder angle relative to the hull;

a slip ratio detector adapted to detect a slip ratio of the propeller based on a theoretical navigation speed and the detected navigation speed of the boat; and a transmission controller adapted to control an operation of the transmission to shift the gears based on at least the detected engine speed when the detected rudder angle is smaller than a predetermined angle, or to shift the gears based on the detected slip ratio when the detected rudder angle is equal to or greater than the predetermined angle, wherein at least one of the slip ratio detectors of the first to third outboard motors calculates a slip ratio difference between the slip ratio detected by the slip ratio detectors of the first and third outboard motors; and the transmission controller of the second outboard motor controls the operation of the transmission of the second outboard motor to shift the gears based on at least the engine speed detected by the engine speed detector of the second outboard motor when the rudder angle detected by one of the rudder angle detectors of the first to third outboard motors is smaller than the predetermined angle, while to shift the gears based on the calculated slip ratio difference when the rudder angle detected by one of the rudder angle detectors of the first to third outboard motors is equal to or greater than the predetermined angle.

2. The apparatus according to claim 1, wherein the transmission controller of the second outboard motor controls the operation of the transmission of the second outboard motor to select one of the gears based on the calculated slip ratio difference when the rudder angle detected by one of the rudder angle detectors of the first to third outboard motors is equal to or greater than the predetermined angle and the engine speed detected by at least one of the first to third outboard motors is equal to or greater than a predetermined engine speed.

3. The apparatus according to claim 1, wherein the transmission controller of the second outboard motor controls the operation of the transmission of the second outboard motor to shift into the first speed gear when the rudder angle detected by one of the first to third outboard motors is equal to or greater than the predetermined angle and the calculated slip ratio difference is equal to or greater than a predetermined slip ratio difference.

4. The apparatus according to claim 3, wherein the transmission controller of the second outboard motors controls the operation of the transmission of the second outboard motor to shift into the second speed gear or higher one when the calculated slip ratio difference becomes smaller than the predetermined slip ratio difference after having been once equal to or greater than the predetermined slip ratio difference.

5. The apparatus according to claim 1, wherein the first to third outboard motors include:

a trim angle adjusting mechanism adapted to adjust the trim angle relative to the hull by trimming it up/down; and a trim angle controller adapted to control the operation of the trim angle adjusting mechanism to make the trim angle to be an initial angle when the detected rudder angle is equal to or greater than the predetermined angle.

6. A control apparatus for an outboard motor system, comprising a boat navigation speed detector adapted to detect a navigation speed of the boat, the outboard motor system including a first outboard motor and a second outboard motor adapted to be mounted on a hull of a boat side by side, each of the first and second outboard motors comprising:

an internal combustion engine provided to power a propeller through a drive shaft;

a transmission including selectable forward first and second speed gears and a reverse gear;

an engine speed detector adapted to detect a speed of the engine;

a rudder angle detector adapted to detect a rudder angle relative to the hull;

a slip ratio detector adapted to detect a slip ratio of the propeller based on a theoretical navigation speed and the detected navigation speed of the boat; and a transmission controller adapted to control an operation of the transmission to shift the gears based on at least the detected engine speed when the detected rudder angle is smaller than a predetermined angle, or to shift the gears based on the detected slip ratio when the detected rudder angle is equal to or greater than the predetermined angle;

a navigation direction detector adapted to detect a navigation direction of the boat;

a direction change amount calculator adapted to calculate an amount of change of the direction per unit time; and a second transmission controller adapted to control the operation of the transmission of the first and second outboard motors to shift the gears based on the calculated amount of change of the direction.

7. The apparatus according to claim 6, wherein the first and second outboard motors include:

a direction storing instructor installed so as to be manipulatable by an operator and adapted to instruct to store the detected direction upon manipulation by the operator; and a direction storer that stores a value of the detected direction based on the instruction of the direction storing instructor, wherein the direction change amount calculator calculates the amount of change of the direction per unit time based on the stored direction.

8. The apparatus according to claim 6, wherein the second transmission controller of the first or second outboard motor controls the operation of the transmission to shift into the first speed gear for the outboard motor situated at an inner side at turning of the boat when the calculated amount of change is equal to or greater than a predetermined value.

9. The apparatus according to claim 6, wherein the second transmission controller of the first or second outboard motor controls the operation of the transmission to shift into the reverse gear for the outboard motor situated at an outer side at turning of the boat when the calculated amount of change is equal to or greater than a predetermined value.

10. The apparatus according to claim 6, wherein the second transmission controller of the first or second outboard motor controls the operation of the transmission to shift into a same gear for all of the first and second outboard motors when the calculated amount of change is smaller than a predetermined value.

* * * * *